US010487490B2

(12) United States Patent
Laundre et al.

(10) Patent No.: US 10,487,490 B2
(45) Date of Patent: Nov. 26, 2019

(54) TOILET INSTALLATION METHOD

(71) Applicant: Kohler Co., Kohler, WI (US)

(72) Inventors: Jeffrey T. Laundre, Sheboygan, WI (US); Daniel N. Halloran, Saukville, WI (US); Randy O. Mesun, Sheboygan, WI (US)

(73) Assignee: KOHLER CO., Kohler, WI (US)

( * ) Notice: Subject to any disclaimer, the term of this patent is extended or adjusted under 35 U.S.C. 154(b) by 16 days.

(21) Appl. No.: 15/938,866

(22) Filed: Mar. 28, 2018

(65) Prior Publication Data

US 2018/0216333 A1 Aug. 2, 2018

Related U.S. Application Data

(63) Continuation of application No. 14/951,024, filed on Nov. 24, 2015, now Pat. No. 9,951,507, which is a continuation of application No. 13/830,715, filed on Mar. 14, 2013, now Pat. No. 9,212,478, which is a continuation-in-part of application No. 13/475,670, filed on May 18, 2012, now Pat. No. 8,978,170.

(60) Provisional application No. 61/488,608, filed on May 20, 2011.

(51) Int. Cl.
*E03D 11/16* (2006.01)

(52) U.S. Cl.
CPC ..... *E03D 11/16* (2013.01)

(58) Field of Classification Search
CPC ..... E03D 11/13; E03D 11/135; E03D 11/16; E03D 11/143
USPC ..... 4/252.1; 285/56, 58
See application file for complete search history.

(56) References Cited

U.S. PATENT DOCUMENTS

| | | | |
|---|---|---|---|
| 167,702 | A | 9/1875 | Smith |
| 519,878 | A | 5/1894 | Stevens, Jr. |
| 928,523 | A | 7/1909 | Kelly |
| 1,334,880 | A | 3/1920 | Auslander |

(Continued)

FOREIGN PATENT DOCUMENTS

| | | |
|---|---|---|
| AT | 319858 | 1/1975 |
| CH | 443169 | 8/1967 |

(Continued)

OTHER PUBLICATIONS

Machine Translation for CH 443169 retrieved from Espacent (Year: 2019).*

(Continued)

*Primary Examiner* — Erin Deery
(74) *Attorney, Agent, or Firm* — Foley & Lardner LLP

(57) ABSTRACT

A method of securing a toilet base that includes coupling a foot of a first support member to a first portion of a trap; pivotally coupling a first clamping member to a leg of the first support member, so that first clamping member can rotate relative to the first support member; placing the toilet base over the trap, so that a skirt of the toilet base surrounds the first support member and the first clamping member; inserting a first adjusting member through a first opening in the skirt so that a shank of the first adjusting member is coupled to a distal end of the first clamping member; and rotating the first adjusting member in a first direction to a secure position in which a head of the first adjusting member loads the skirt and the first support member loads the shank to secure the toilet base to the trap.

20 Claims, 20 Drawing Sheets

(56) References Cited

U.S. PATENT DOCUMENTS

| | | | |
|---|---|---|---|
| 2,517,411 | A | 8/1950 | Patterson |
| 2,681,780 | A | 6/1954 | Santoro |
| 2,689,701 | A | 9/1954 | Whitaker |
| 3,026,075 | A | 3/1962 | Phelon et al. |
| 3,148,379 | A | 9/1964 | Muller |
| 3,334,362 | A | 8/1967 | Muller |
| 3,486,204 | A | 12/1969 | Hurtner et al. |
| 3,680,154 | A | 8/1972 | Stairs |
| 3,693,918 | A | 9/1972 | Fisher |
| 3,696,918 | A | 10/1972 | Lerner |
| 3,896,510 | A | 7/1975 | O'Connell |
| 4,007,901 | A | 2/1977 | Mancini et al. |
| 4,913,395 | A | 4/1990 | Juhas |
| 5,743,508 | A | 4/1998 | Fiveash |
| 5,984,248 | A | 11/1999 | Evans et al. |
| 6,292,956 | B1 | 9/2001 | Kayahara |
| 7,165,275 | B2 | 1/2007 | Clark |
| 7,984,884 | B1 | 7/2011 | Iliev |
| 8,037,637 | B2 | 10/2011 | Odom, Jr. |
| 2002/0084397 | A1 | 7/2002 | Ross, Jr. |
| 2003/0145429 | A1 | 8/2003 | Twomey |
| 2010/0175176 | A1 | 7/2010 | Ollila |

FOREIGN PATENT DOCUMENTS

| | | |
|---|---|---|
| CN | 1628204 | 6/2005 |
| CN | 2828172 | 10/2006 |
| DE | 2117777 | 10/1972 |
| EP | 345610 | 12/1989 |
| EP | 504587 | 9/1992 |
| GB | 1074887 | 7/1967 |
| JP | H09119166 | 5/1997 |
| LU | 42232 | 10/1962 |

OTHER PUBLICATIONS

International Search Report and Written Opinion for International Application No. PCT/US2012/038652, dated Sep. 26, 2012, 7 pages.

First Office Action in related Chinese Application No. 201280002248.0 dated Nov. 20, 2013, 18 pages.

* cited by examiner

TOILET INSTALLATION METHOD

CROSS-REFERENCE TO RELATED PATENT APPLICATIONS

This application is a Continuation of U.S. patent application Ser. No. 14/951,024, filed on Nov. 24, 2015, which is a Continuation of U.S. patent application Ser. No. 13/830,715, filed on Mar. 14, 2013 and issued on Dec. 15, 2015 as U.S. Pat. No. 9,212,478, which is a Continuation-In-Part of U.S. patent application Ser. No. 13/475,670, filed on May 18, 2012 and issued on Mar. 17, 2015 as U.S. Pat. No. 8,978,170, which claims the benefit of and priority to U.S. Provisional Patent Application No. 61/488,608 filed on May 20, 2011. All of the foregoing U.S. patent applications are incorporated by reference herein in their entireties.

BACKGROUND

The present application relates generally to the field of toilets. More specifically, the present application relates to improved systems and methods for installing a toilet (e.g., coupling the toilet to a trap assembly and/or mounting the toilet to the floor).

There is an increasing demand from consumers for toilets having bases or pedestals with smooth exterior surfaces, in part due to their improved aesthetics and cleanability. These toilets with smooth exterior surfaces may include pedestal side walls (or portions thereof) that are spaced a distance outward from the internal trapway of the toilet (hereinafter referred to as "skirted toilets"). In other words, the skirted feature of the toilet is created by the pedestal having a wall with a smooth exterior surface for aesthetic purposes and an interior surface that is separated by a gap (e.g., open space) from the external surfaces of the passageway (e.g., trap passageway). Many conventional non-skirted toilets have pedestals that include externally visible fasteners, indentations or voids (e.g., voids that outline the functional features, such as the trapway, contained within the toilet to transfer the water and waste), and other features that it may be desirable to eliminate for aesthetic and other purposes.

One challenge associated with skirted toilets relates to the manner in which such toilets must be mounted or coupled to the trap assembly and/or to the floor to prevent rotating, twisting, or rocking of the toilet during the user experience. For conventional toilets, a typical mounting method involves inserting a fastener through a horizontal portion (e.g., flange) of the toilet base or pedestal directly into the closet flange, the soil pipe, and/or the floor (i.e., the fastener is arranged perpendicular to the surface of the floor). In skirted toilets, however, such a configuration may not be appropriate or desirable because of the design of the skirted portion (e.g., there may not be a surface of the skirt that is parallel to the floor that would allow a fastener to be driven directly through the toilet and into the closet flange and/or the floor). It would be advantageous to provide a simple and secure method and system for mounting or coupling a skirted toilet to the trap, soil pipe, and/or the floor without having functional issues (e.g., leaking) and/or aesthetic issues (e.g., large openings requiring additional vitreous plastic covers or patches).

Additionally, there is a need to provide a more secure coupling between the toilet and the closet flange and/or the soil pipe, in order to improve the stability of the toilet, such as during use of the toilet, as well as, to reduce the likelihood of leaking, such as between the toilet and the drain pipe (or soil pipe or sanitary sewer system). Current skirted toilet couplings (or installation mountings) only provide either a horizontal force or a vertical force, but not both, to secure the toilet to the soil pipe. It would be advantageous to be able to couple the toilet to the soil pipe in a manner that provides both horizontal and vertical clamping forces to more securely couple the toilet and to reduce the likelihood of leaking, while simultaneously minimizing the aesthetic impact of the coupling (or fastening) system.

SUMMARY

One embodiment relates to a mounting assembly for securing a pedestal of a toilet to a trap. The mounting assembly includes a support member having a leg and a foot configured to be coupled to the trap, a clamping member including a bore and a distal end pivotally coupled to the leg of the support member, and an adjusting member extending through an opening in a wall of the pedestal, through an opening in the leg of the support member, and into the bore of the clamping member. Adjustment of the adjusting member pivots the clamping member relative to the support member to change a pitch of the adjusting member such that the adjusting member imparts a load into both the support member and the wall of the pedestal.

The load into the support member may be imparted to a surface of the support member that defines the opening in the leg. The surface of the support member may be an upper surface of the opening such that the load into the support member is a vertical load, and wherein the upper surface acts as a fulcrum as the pitch of the adjusting member is changed. The load into the wall of the pedestal may be a vertical load into a surface of the wall, where the surface of the wall may define the opening in the wall. The mounting assembly may be configured such that pivoting of the clamping member from adjustment of the adjusting member imparts an axial load into a shank of the adjusting member, which in turn imparts a horizontal load into the wall of the pedestal through a head of the adjusting member. The mounting assembly may be configured with a ratio of the vertical load into the wall to the horizontal load into the wall of at least 1:1.

The mounting assembly may further include a pivot member disposed in a second bore of the clamping member, where the pivot member is configured to pivot relative to the clamping member, and the pivot member includes a bore configured to operatively couple to a shank of the adjusting member. The mounting assembly may be configured having a first length between a pivot axis of the pivot member and a pivot axis of the distal end of the clamping member that is greater than a second length between the pivot axis of the distal end of the clamping member and a longitudinal axis of the adjusting member. The second length may be configured transverse to the longitudinal axis of the adjusting member. The mounting assembly may further include a second pivot member that pivotally couples the distal end of the clamping member to a pair of opposing tabs of the support member, where each tab extends from the leg in a generally perpendicular direction and includes an opening therein to receive a portion of the second pivot member.

Another embodiment relates to a toilet including a pedestal, a trap, and a mounting assembly. The pedestal includes a bowl and a wall with an opening therein. The trap includes a passageway in fluid communication with the bowl and a base configured to be coupled to a soil pipe. The mounting assembly is configured to couple the pedestal to the trap. The mounting assembly includes a support member coupled to the trap, a clamping member including a bore and a distal end pivotally coupled to the support member, and an adjusting member extending through the opening in the wall, through an opening in the support member, and into the bore of the clamping member. Adjustment of the adjusting member pivots the clamping member relative to the support member to move the adjusting member such that the adjusting member imparts a load into both the support member and the wall of the pedestal.

The support member may include a leg and a foot, where the foot includes a second opening to receive a fastener to adjustably couple the support member to the trap. The mounting assembly of the toilet may also include a pivot member pivotally coupling the distal end of the clamping member to the leg of the support member. The opening in the support member may be provided in the leg and may be disposed on an opposite side of the leg to which the foot is disposed relative to the pivot member. The mounting assembly of the toilet may also include a pivot member disposed in a second bore of the clamping member, where the pivot member includes a bore configured to operatively couple to the adjusting member, and where the pivot member is configured to pivot relative to the clamping member. The support member may be adjustable such that the leg can be moved closer to or farther away from the wall of the pedestal.

The toilet may further include a second mounting assembly for coupling the pedestal to the trap. The second mounting assembly may include a second support member coupled to the trap, a second clamping member including a bore and a distal end pivotally coupled to the second support member, and a second adjusting member extending through a second opening in a second wall of the pedestal, through an opening in the second support member, and into the bore of the second clamping member. Adjustment of the second adjusting member pivots the second clamping member relative to the second support member to move the second adjusting member such that the second adjusting member imparts a load into both the second support member and the second wall of the pedestal. The second mounting assembly may be provided on an opposite side of the passageway of the trap relative to the mounting assembly. The mounting assembly and the second mounting assembly may be adjusted independently of the other mounting assembly, such that the mounting assembly provides a first horizontal load and a first vertical load, and the second mounting assembly provides a second horizontal load and a second vertical load, which are different than the first horizontal and vertical loads.

Yet another embodiment relates to a mounting assembly for securing a pedestal of a toilet to a trap. The mounting assembly includes a support member configured to be coupled to the trap, clamping member pivotally coupled to the support member, and a threaded adjusting member extending through an opening in the pedestal, through an opening in the support member, and into a bore of the clamping member. Rotation of the threaded adjusting member pivots the clamping member relative to the support member to move the threaded adjusting member such that the adjusting member imparts a load into both the support member and the wall of the pedestal.

The mounting assembly may further include a pivot member operatively coupled to the clamping member, where the pivot member includes a threaded bore configured to receive the threads of the adjusting member, such that rotation of the adjusting member moves the pivot member along the adjusting member by the threads and pivots the clamping member. The pivot member may be disposed in a second bore of the clamping member, and the pivot member may be configured to rotate about a rotational axis in the second bore relative to the clamping member. The rotational axis of the second bore may extend in direction that is transverse to a longitudinal axis of a shank of the threaded adjusting member. The mounting assembly may further include a second pivot member that pivotally couples the clamping member to the support member. The second pivot member may define a pivot axis that is generally parallel to the rotational axis of the pivot member.

DETAILED DESCRIPTION

With general reference to the Figures, disclosed herein are toilets configured having a coupling or mounting assembly configured to secure a pedestal of the toilet to a trap, which may be coupled to a soil pipe (e.g., a drain pipe). The coupling assemblies are configured to be located within the pedestal, such that they are hidden from view outside the pedestal to provide a cleaner look to the toilet. The mounting assemblies as disclosed herein may include a clamping member and an adjusting member. The clamping member may be pivotally coupled to the trap and may include an opening extending through the clamping member. The adjusting member may be provided in the opening of the clamping member and may be configured to be engaged by the clamping member and the pedestal, such as a wall of the pedestal. The adjusting member may be configured to pivot the clamping member into and out of engagement with the adjusting member, such as to secure and unsecure the pedestal from the trap, respectively. The mounting assemblies as disclosed herein may advantageously be configured to secure the pedestal of the toilet from inside the pedestal (e.g., inside the wall forming the pedestal) with just a portion of the adjusting member being visible. The mounting assemblies as disclosed herein may also advantageously be configured to apply clamping forces in more than one direction, such as, for example, in both the horizontal and vertical directions, to more securely couple the pedestal to the trap and thereby to the floor.

Figure 1:
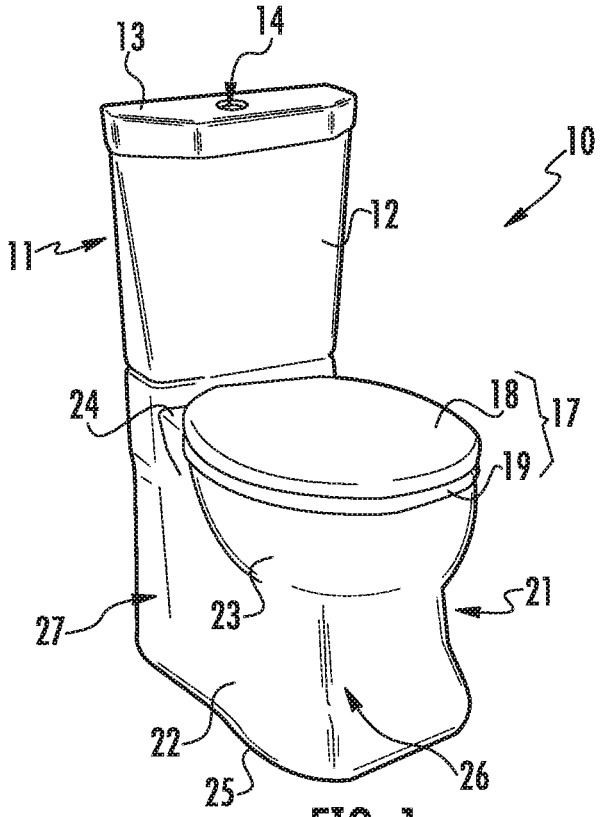
FIG. 1 is a perspective view of a toilet having a fully skirted pedestal or base.

FIG. 1 illustrates an exemplary embodiment of a skirted toilet 10 that includes a tank 11, a pedestal 21 (or base), a seat assembly 17 and a coupling or mounting assembly (not shown). The tank 11 may include a hollow bowl 12 for storing the water used during operational (or flushing) cycles, a lid (or cover) 13 for providing selective access into the bowl 12, and an actuator 14 that is configured to initiate an operational cycle when activated. The actuator 14 may be a button configured to activate when depressed (or pulled) a predetermined distance or when touched, a lever configured to activate when rotated a predetermined angular travel, or any suitable device configured to activate based upon an input manipulation by a user.

It should be noted that the shapes and configurations of the tank, pedestal, seat assembly, and the internal components (including the trapways and other features) may vary from the embodiments shown and described herein, and that the embodiments disclosed herein are not intended as limitations. It should be noted, for example, that although the exemplary embodiment of the toilet 10 is shown configured with the tank 11 formed separately from the pedestal 21 and later coupled to the pedestal, the tank may be integrally formed with the pedestal as a one-piece design. In other words, the toilet may be a one-piece design, a two-piece design, or have any suitable configuration. The installation (e.g., mounting, coupling) systems and methods described herein may be used with a wide variety of skirted toilet configurations, and all such configurations are intended to be encompassed herein. The following description of various toilet features is therefore intended as illustration only of one possible embodiment, and it should be understood by those reviewing the present description that similar concepts or features may be included in various other embodiments.

The tank 11 may include an inlet opening (not shown) configured to receive water from a coupled water supply (not shown), such as from a hose (e.g., line, tube). The tank 11 may also include an inlet valve assembly (not shown) or other device configured to control the flow of water from the water supply into the tank through the inlet opening. Within the tank 11 may be provided a float device (not shown) for controlling the inlet valve assembly, such as by opening the valve to refill the bowl 12 of the tank 11 after an operational cycle and closing the valve when the water in the bowl 12 reaches a preset volume or height. The tank 11 may also include an outlet opening (not shown) configured to transfer (e.g., conduct) the water stored in the bowl 12 of the tank to the pedestal 21 (e.g., the bowl) upon activation of the actuator 14. The tank 11 may include an outlet valve assembly (not shown) or other device configured to control the flow of water from the tank into the pedestal 21 through the outlet opening.

The pedestal 21 (or base) of the toilet 10 may include a wall 22 having any suitable shape that is configured to form a bowl 23 having an opening formed by an upper rim at the top of the opening. The pedestal 21 may also be configured to include a plurality of walls having varying shapes that together form a bowl having an opening formed by a rim. The wall 22 of the pedestal may extend downward and/or rearward from the bowl 23 to form a lower portion 25 configured to support the pedestal 21 and the toilet 10. The lower portion 25 may be formed by the end (e.g., lower rim) of the wall 22, or may include a member that extends generally in a horizontal plane from one or more than one end of the wall. The pedestal 21 may also include a top member 24 that extends between two sides of the wall 22 (or between two opposing walls) and is provided rearward (or behind) the bowl 23, wherein the top member 24 forms a plateau for supporting the tank 11, such as the bottom surface of the bowl 12 of the tank 11. The top member 24 may include an inlet opening (not shown) that may be aligned with the outlet opening of the tank 11, such as when the tank 11 is coupled to (or resting above) the pedestal 21, wherein water is selectively transferred (e.g., conducted) from the tank 11 through the outlet opening of the tank to the pedestal 21 through the inlet opening of the pedestal 21, when the toilet is activated through the actuator 14. The outlet valve assembly may control the flow of water from the tank to the pedestal. The toilet may also include a gasket or seal (not shown) that is provided between the tank 11 and the pedestal 21 to prohibit leaking. For example, a gasket may be provided between the outlet opening of the tank and the inlet opening of the pedestal to prohibit leaking between the tank and the pedestal.

The plateau formed by the top member 24 of the pedestal 21 may also provide for coupling of the seat assembly 17 to the pedestal 21 of the toilet 10. For example, the top member 24 may include one or more than one opening, wherein each opening is configured to receive a fastening device (e.g., bolt, screw, etc.) to couple (e.g., attach) the seat assembly 17 to the top member 24 of the pedestal 21. As another example, the top member 24 may include one or more than one fastening device (e.g., bolts, recessed nuts, etc.) integrally formed therein (i.e., already provided connected or coupled to the pedestal 21), wherein the fastening device may be used to couple or secure at least a portion of the seat assembly 17 to the pedestal 21.

The bowl 23 of the pedestal 21 may be configured to include a receptacle (e.g., sump) and an outlet opening, wherein the water and waste is collected in the receptacle until being removed through the outlet opening, such as upon activation of the actuator 14. The pedestal 21 may also include a passageway (not shown), such as a passageway, that fluidly connects the outlet opening of the bowl 23 to an exiting device (e.g., a trap or a soil pipe). The passageway generally includes a first portion, a second portion, and a weir separating the first and second portions. The first portion of the passageway may extend from the outlet opening of the bowl 23 at an upwardly oblique angle to the weir. The second portion of the passageway may extend from the weir downwardly to the exiting device, such as to the trap.

Between operational cycles of the toilet 10, the water (and waste) is collected in the first portion of the passageway (in addition to the receptacle of the bowl), such that the weir prohibits the water from passing past the weir and into the second portion of the passageway. Upon activation of the actuator 14, additional water is discharged from the tank 11 into the bowl 23 of the pedestal 21, resulting in the flushing action and waste removal through the soil pipe.

The seat assembly 17 may include a cover member 18 (e.g., lid), a seat member 19 (e.g., ring member), and a hinge (not shown). The seat member 19 may be configured to include an annular member that encircles an opening, wherein the annular member provides a seating surface for the user of the toilet 10. The seat member 19 may also be pivotally coupled (e.g., attached) to the hinge, wherein the seat member may rotate (or pivot) about the hinge, such as between a first lowered or seated position and a second raised or upright position. The cover member 18 may be configured to be round, oval, or any other suitable shape. Typically, the profile or shape of the outer surface of the cover member will be configured to match (i.e., to be substantially similar) to the profile of the outer surface of the seat member to improve the aesthetics of the seat assembly and toilet. The cover member 18 may also be coupled to the hinge, wherein the cover member may rotate (or pivot) about the hinge, such as between a first down lowered or down position and a second raised or upright position. The cover member 18 may be provided above the seat member in the down position to thereby cover the opening of the seat member 19, as well as to conceal the inside of the bowl 23 of the pedestal 21. The cover member 18 may be configured to rest against the outside surface of the tank 11, when the cover member 18 is in the upright position, such that the cover member 18 remains in the upright position in order for a user to sit upon the seat member 19.

Figure 2:
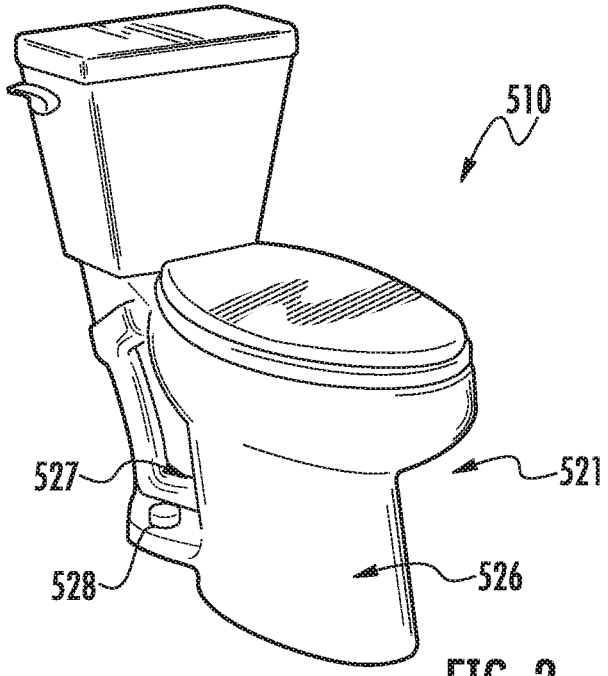
FIG. 2 is a perspective view of a toilet having a non-skirted pedestal.

In contrast to the skirted toilet shown in FIG. 1, a non-skirted toilet is illustrated generally in FIG. 2. The pedestal 521 of the non-skirted toilet 510 is generally configured with a smooth contour in the forward portion 526 (i.e., directly below the bowl down to the base), however, the rearward portion 527 of the pedestal is configured with an irregular (or non-harmonious) contour that includes one or more large voids or indentations that typically follow the contour of the trapway passage. The non-skirted toilet 510 generally is coupled to the soil pipe (and/or the floor of the washroom) using bolts that are covered by covers 528. The irregular contour of the rearward portion 527, as well as the covers 528, may not be desirable in certain applications (e.g., where different aesthetics are desired by the consumer and/or installer). Additionally, the irregular contours of the non-skirted toilets are more difficult to clean relative to the smooth and harmonious contour of the skirted toilets.

As shown in FIG. 1, the pedestal 21 of the toilet 10 includes a full skirt, wherein the side walls 22 of the pedestal 21 extend generally from below and behind the bowl 23 rearward to the rear wall (e.g., back surface) of the pedestal 21 with a smooth contour. Thus, the pedestal 21 of the fully skirted toilet 10 includes both a forward portion 26 and a rearward portion 27 configured to have a relatively smooth (or harmonious) contour, which is minimally interrupted by indentations or voids. For example, the pedestal 21 of the toilet 10 may include substantially smooth side walls 22 from the front portion to the rear portion. It should be noted that a skirted toilet may not have a completely smooth (or harmonious) pedestal and the exemplary embodiments shown and described herein are not meant as limitations.

Figure 3:
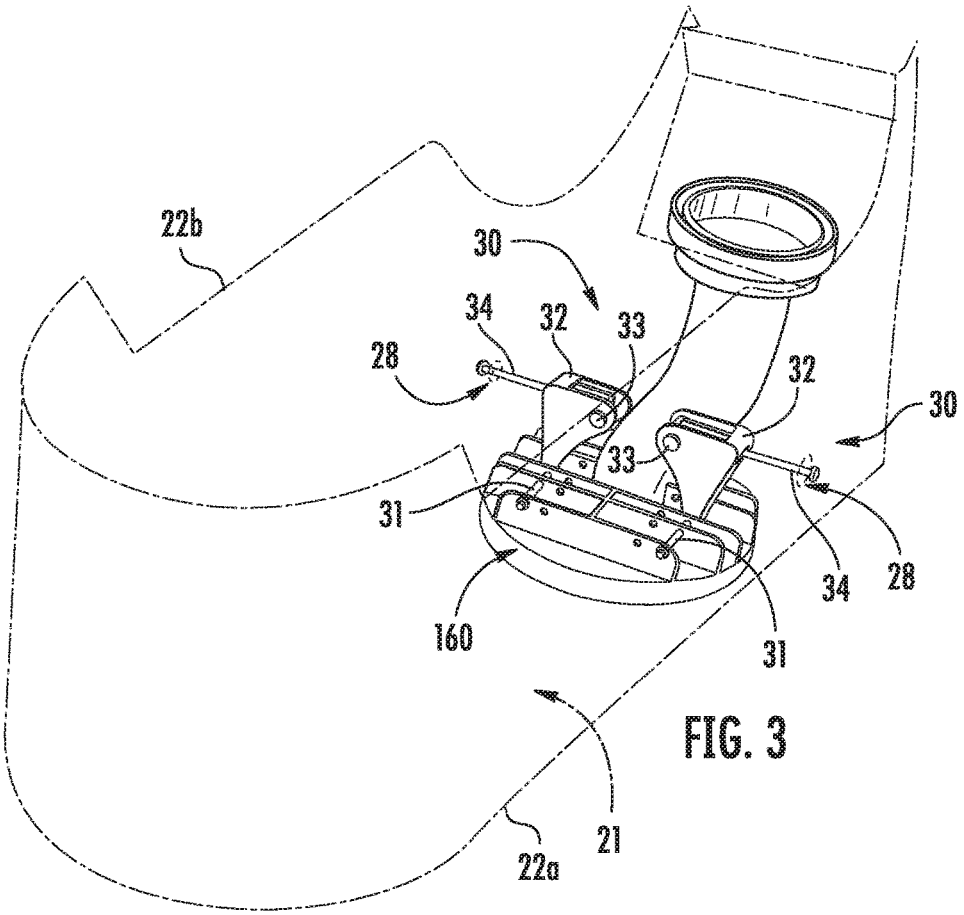
FIG. 3 is a perspective view of a pedestal or base for a toilet, illustrating a coupling or mounting assembly for securing the pedestal to a trap and/or the floor.
Figure 4:
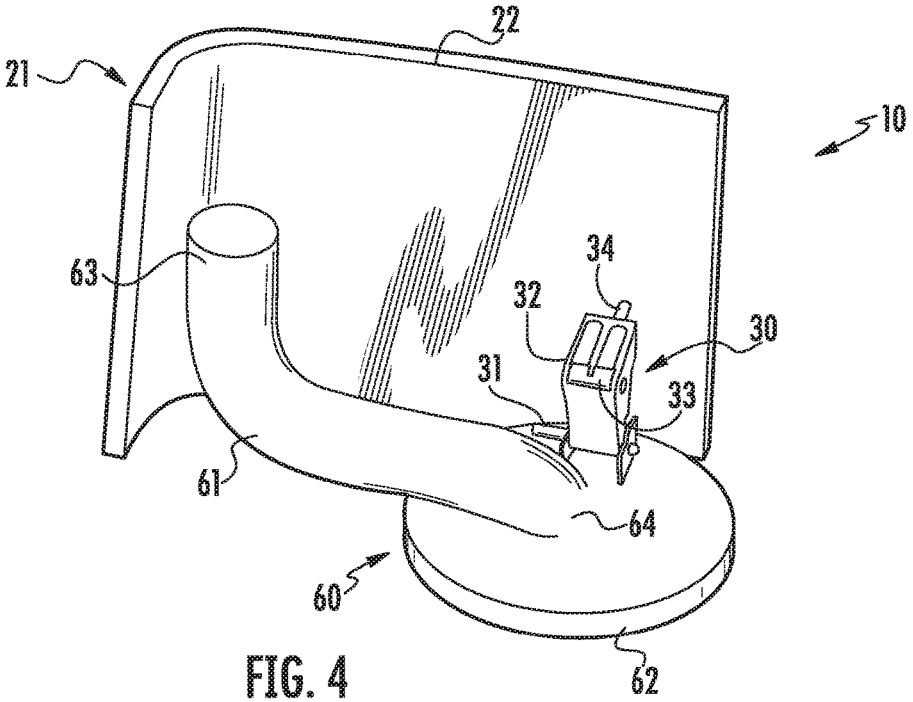
FIG. 4 is a side perspective view of an exemplary embodiment of a coupling or mounting assembly shown coupling the pedestal of the toilet to a trap.
Figure 5:
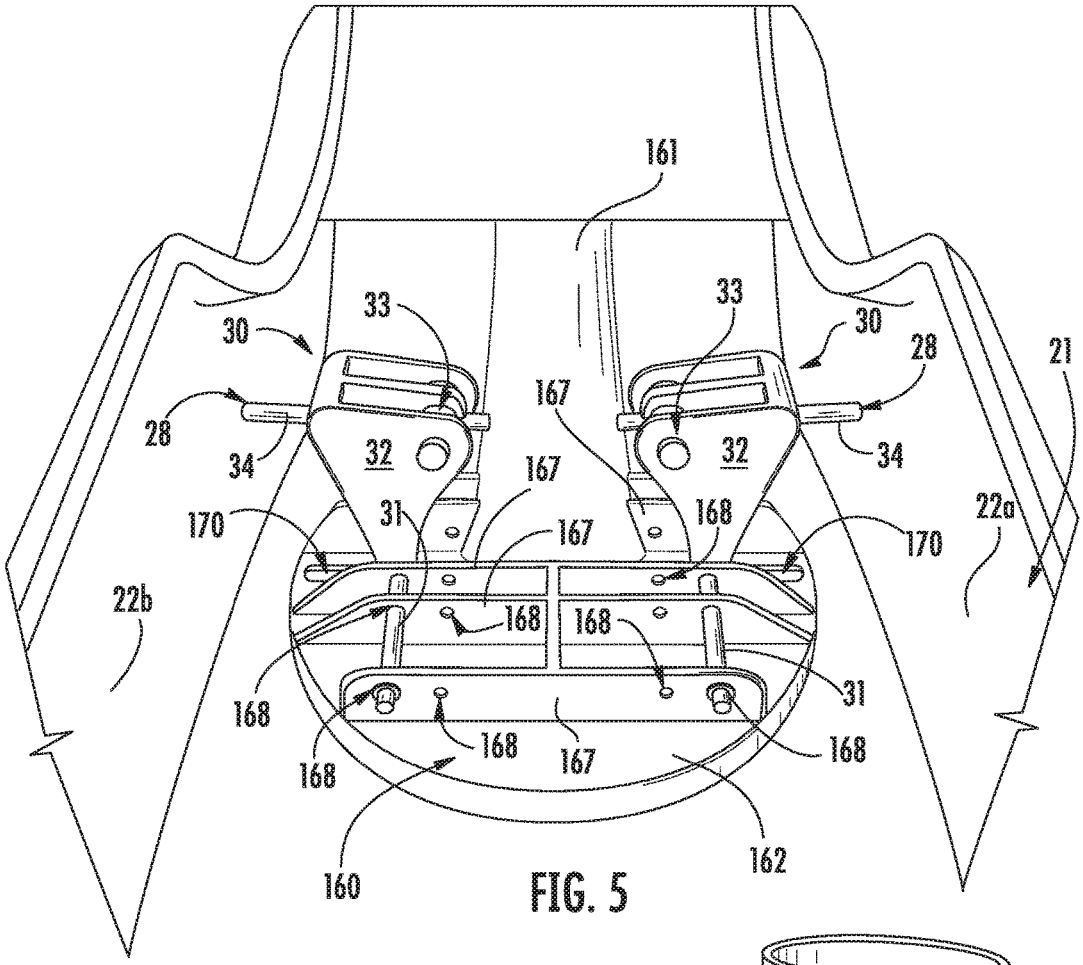
FIG. 5 is a front perspective view of the coupling or mounting assembly of FIG. 4 shown coupling the pedestal of the toilet to another trap.

FIGS. 3-5 illustrate an exemplary embodiment of an installation or mounting assembly 30 (referred to below as a "coupling assembly") configured for securing a pedestal or base of a skirted toilet in place in a desired location. For ease of description, the following text will refer to the components of the toilet shown in FIG. 1, although it should be understood that similar concepts will apply to most any toilet having particular value for skirted toilets. According to an exemplary embodiment, the toilet 10 may include two coupling assemblies 30, wherein the first coupling assembly 30 is configured to couple the right wall 22*a* of the pedestal 21 to a trap 60 (or to a mounting structure separate from the trap 60) and the second coupling assembly 30 is configured to couple the left wall 22*b* of the pedestal 21 to the trap 60 (or to a mounting structure separate from the trap 60). According to other exemplary embodiments, the toilet may be configured to include only one coupling assembly or a plurality of coupling assemblies.

Figure 6:
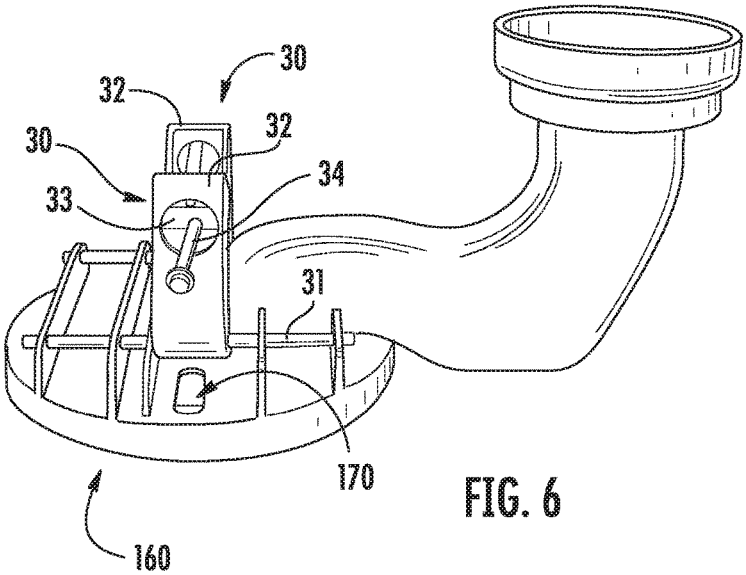
FIG. 6 is a side view of the coupling assembly of FIG. 4 shown coupled to a trap.

The coupling assembly 30 is uniquely configured to provide horizontal and vertical loading (e.g., clamping) to secure the toilet 10, such as by securing the pedestal 21 of the toilet 10 to the trap 60, which may be fixedly coupled to the soil pipe and/or the floor of the washroom. The method of achieving the horizontal and vertical forces (e.g., loading) to secure the toilet is discussed in greater detail below. FIG. 6 illustrates the two coupling assemblies 30 coupled only to the trap 60 and not coupled to the pedestal.

The trap 60 may be made from a polymer or a composite material through a molding (e.g., injection molding) process, may be made from a metal (e.g., steel, cast iron, etc.) through a casting or other forming process, or may be made from any suitable material through any suitable process as may be appropriate or desired for a given application. According to the exemplary embodiment shown in FIG. 4, the trap 60 includes a trap passageway 61 that extends from a base 62. The trap passageway 61 may be a hollow portion (e.g., tube) having a first end 63 and a second end 64. The first end 63 of the trap passageway 61 may be configured to be coupled to the toilet, such as to the internal pedestal passageway, to connect (e.g., fluidly, structurally) the passageway and the trap passageway. The second end 64 of the trap passageway 61 may be configured to be coupled to the soil pipe, which may be provided in the floor or wall, to connect (e.g., fluidly, structurally) the trap passageway to the building soil (or drain) pipe. Thus, water and waste may pass from the passageway through the trap to the soil pipe when the toilet is activated. It should be noted that the toilets as described and shown herein may include a single passageway or may include more than one passageways coupled together (e.g., a trap passageway coupled to an internal pedestal passageway) to transfer the water and waste from the bowl of the pedestal to the soil pipe. Thus, trap passageway and internal pedestal passageway may be separate members of the toilet or may be different portions of an integrally formed passageway.

The base 62 of the trap 60 may be circular shaped and may surround a portion of the second end 64 of the trap passageway 61. The base 62 may be configured to be coupled to the gasket (e.g., wax ring), the soil pipe and/or to the floor of the washroom, such as through conventional fasteners (e.g., bolts, screws, etc.). The base 62 may also be configured to be coupled to the coupling assembly 30, as discussed in more detail below, to secure (e.g., couple) the toilet to the soil pipe and/or the floor of the washroom through the trap 60. According to other exemplary embodiments, the base and other features of the trap may have different configurations (e.g., the base may be non-circular).

FIGS. 9-14 illustrate an exemplary embodiment of the coupling assembly 30 that is configured to secure the toilet in place, such as by providing horizontal and vertical loading to couple the wall 22 of the pedestal 21 to the trap 60. The coupling assembly 30 may include a pin 31, a clamping member 32 (e.g., linking member), a pivot member 33, and an adjusting member 34 (e.g., a fastener such as a bolt having a threaded portion). The pin 31 may couple the clamping member 32 to the trap 60, such that the clamping member 32 may pivot or rotate about the pin 31 relative to the trap 60. The pivot member 33 may be coupled to the clamping member 32, such that the pivot member 33 may pivot or rotate relative to the clamping member 32. The pivot member 33 may also be configured to receive the adjusting member 34, wherein the adjusting member 34 may be configured to adjust the position of the clamping member 32 to thereby increase or decrease the loading (e.g., horizontal loading, vertical loading) provided by the coupling assembly 30.

Figure 10:
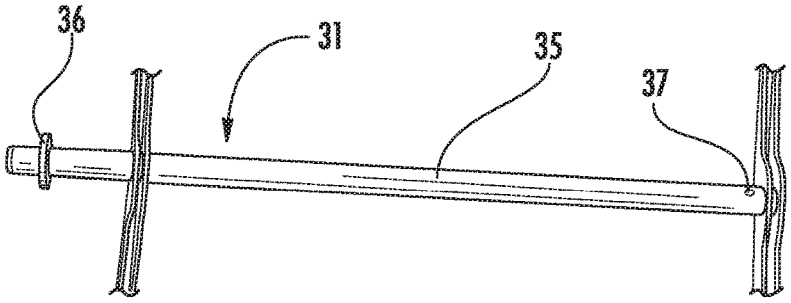
FIG. 10 is a perspective view of an exemplary embodiment of a pin configured for use in a coupling or mounting assembly, such as the coupling assembly shown in FIG. 9.

According to the exemplary embodiment shown in FIG. 10, the pin 31 may be a cylindrically shaped pin made from a metal (e.g., steel, brass, stainless steel), a polymer, a composite, or any suitable material that is strong enough to withstand the stresses induced by loads induced by the coupling assembly 30. The pin 31 may include a body 35, a shoulder 36, and an opening 37. The shoulder 36 may be provided on one end of the body 35 and may be configured having a larger diameter relative to the diameter of the body 35, wherein the shoulder 36 may be configured to contact a feature of the trap 60 to limit the travel of the pin 31 relative to the trap 60. The opening 37 of the pin 31 may be provided on the other end of the body 35 and may be configured to receive a device (e.g., pin, cotter pin, etc.) in order to limit the travel of the pin 31 in the direction opposite to the direction that the shoulder limits travel. According to other embodiments, the pin 31 may be configured as a bolt, screw, rivet, or any suitable device that may couple two objects together and allow for the first object (e.g., clamping member) to rotate relative to the second object (e.g., trap).

Figure 11:
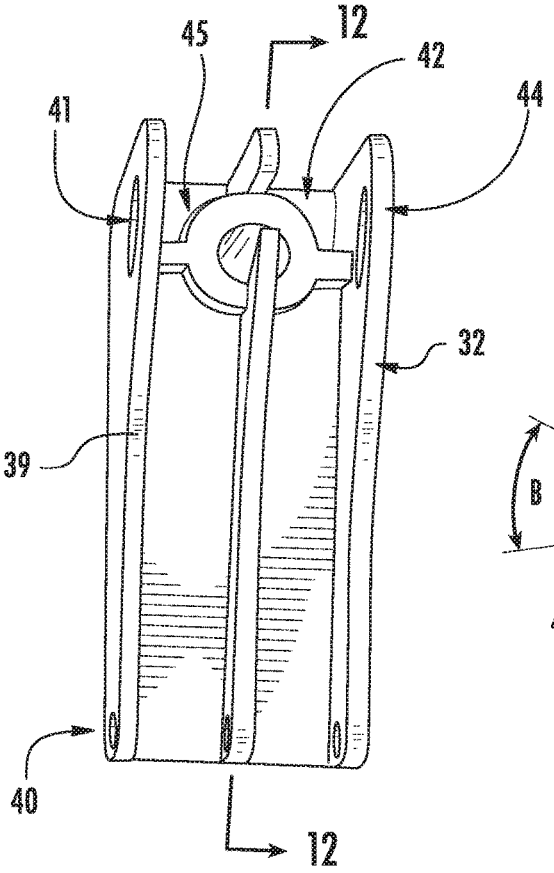
FIG. 11 is a perspective view of an exemplary embodiment of a clamping member configured for use in a coupling or mounting assembly, such as the coupling assembly shown in FIG. 9.
Figure 12:
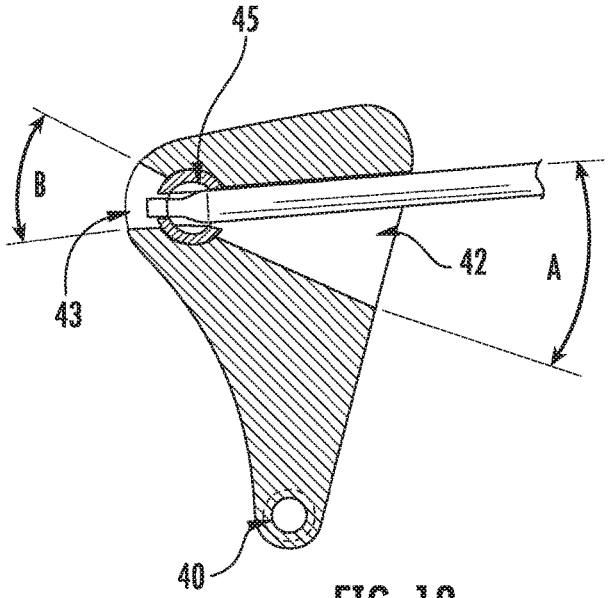
FIG. 12 is a cross-sectional view of the clamping member of FIG. 11 taken along line 12-12, shown with an adjusting member engaging a pivot member.

According to the exemplary embodiment shown in FIGS. 11 and 12, the clamping member 32 may be made from a polymer, a composite material, a metal (e.g., brass, stainless steel), or any suitable material that is strong enough to withstand the stresses induced by loads generated by the coupling assembly 30 in order to secure the toilet, as well as loads resulting from actual toilet use. According to an exemplary embodiment, the clamping member is made from a polymeric material and includes features (e.g., ribs) for providing enhanced rigidity and/or strength for the clamping member.

The clamping member 32 may include a body 39 that has a generally triangular cross-section (with rounded corners and one or more non-straight sides), with the legs of the triangular shape being longer than the base of the triangular shape, wherein the legs point downwardly and the base is above the legs. The clamping member may also include a base and two side walls, wherein each side wall has a polygonal or other cross-section that extends from the base. It should be noted that the clamping member may be configured to have any shape suitable for withstanding the stresses and/or for transferring the horizontal and vertical forces that result during coupling the toilet and securing the toilet during subsequent use of the toilet. Thus, the embodiments of the clamping members disclosed herein are not intended to serve as limitations.

The clamping member 32 may include a first opening 40 (e.g., aperture, hole, etc.), a second opening 41 (e.g., aperture, hole, etc.), and a third opening 42 (e.g., aperture, hole, etc.). The first opening 40 may be provided near the lower point of the triangular shaped body 39 (i.e., where the legs intersect) and may extend through the width of the body 39 to provide a pivot axis for the clamping member 32 to pivot about. The first opening 40 may be configured to be round to receive the pin 31, such as the body 35 of the pin 31, wherein that the clamping member 32 may rotate or pivot about the pin 31 and about the axis defined by the first opening 40. The second opening 41 may be provided near one of the upper points of the triangular body 39 (i.e., where one of the legs intersects the base) and may extend through the width of the body 39. The second opening 41 may be configured to be round to receive the pivot member 33, wherein the pivot member 33 may rotate or pivot relative to the clamping member 32 about the axis formed by the pivot member and second opening 41 of the clamping member. The clamping member 32 may also include a cavity 45 configured to retain the pivot member 33 from moving linearly relative to the clamping member 32, while allowing rotation of the pivot member 33 relative to the clamping member 32. The cavity 45 may be defined by the second opening 41, such as by being an extension of the second opening 41, may be a bore configured adjacent to the second opening 41, or may have any other suitable configuration.

The third opening 42 of the clamping member 32 may extend through the upper portion of the body 39 in a direction transverse to the first and second openings 40, 41. According to an exemplary embodiment, the third opening 42 is configured to be cone shaped (as shown in FIG. 12). The surface of the cone shaped third opening 42 may extend approximately from the axis of the second opening 41 in two directions at an angle A (as shown in FIG. 12) relative to each other, such that the third opening 42 becomes increasingly larger at locations along the opening that are farther from the axis of the second opening 41. The third opening 42 is configured to receive the adjusting member 34 of the coupling assembly 30, in order for the threaded portion 51 of the adjusting member 34 to be easily inserted into the threaded portion 47. Also, when the adjusting member 34 is adjusted, the clamping member 32 may be configured to move (or pivot) about the first opening 40, to change the alignment of the adjusting member 34 within the third opening 42 to thereby change the clamping forces or loads (e.g., horizontal clamping loads, vertical clamping loads). This function (e.g., adjustable loading) is discussed in more detail below.

According to other exemplary embodiments, the third opening 42 may be configured to have any other shape, such as being curved (e.g., concave, convex) or irregular. Also, the surface or surfaces that define the shape of the third opening 42 may include a cam or a cam surface (i.e., an eccentric surface having a center axis that is offset from the pivot axis of the cam), wherein the cam surface may be configured to influence the forces or loads (e.g., vertical load, horizontal load), such as when the adjusting member is adjusted. For example, a cam surface may protrude beyond the conical surface defining the third opening 42 (i.e., the cam surface may extend into the opening defined by the otherwise conical surface) to impart forces into the adjusting member to secure the toilet in place. It should be noted that the geometric configuration of the cam may be varied to tailor the forces securing the toilet in place.

The clamping member 32 may also include a fourth opening 43 that extends through the upper portion of the body 39 away from the third opening 42 (and transverse to the first and second openings 40, 41). The fourth opening 43 may be cone shaped, curved, or may have any suitable shape. For example, the sides of the cone shaped fourth opening 43 may extend approximately from the axis of the second opening 41 in two directions at an angle B (as shown in FIG. 12) relative to each other, such that the fourth opening 43 becomes increasingly larger at locations along the opening that are farther from the axis of the second opening 41. The fourth opening 43 may be configured to receive a portion of the adjusting member 34, such as the end of the adjusting member 34 that passes through the pivot member 33 when the adjusting member is adjusted. In other words, the shape of the fourth opening 43 may be configured to allow the adjusting member 34 to pass through the pivot member 33 and to allow for the change in alignment between the adjusting member 34 and the clamping member 32 when the adjusting member 34 is adjusted.

Figure 13:
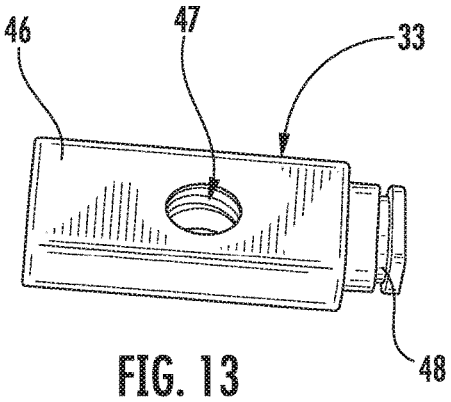
FIG. 13 is an exemplary embodiment of an pivot member configured for use in a coupling or mounting assembly, such as the coupling assembly shown in FIG. 9.

According to the exemplary embodiment shown in FIG. 13, the pivot member 33 includes a body 46 and a threaded portion 47 (e.g., threaded insert). The pivot member 33 may be configured to transfer load (e.g., forces), provide a controlled rotation and retain the adjusting member 34. The body 46 may be cylindrically shaped to provide a bearing surface for the pivot member 33 to pivot (or rotate) relative to the clamping member 32, and the body 46 may be made from a polymer, a composite material, a metal (e.g., brass, stainless steel), or any suitable material that is strong enough to withstand the stresses induced by loads generated by the coupling assembly and allows for efficient relative rotation.

The threaded portion 47 may include threads provided along an inner diameter that are configured to be engaged by mating threads from the adjusting member 34 to provide adjustable coupling between the pivot member 33 and the adjusting member 34 in order to tailor the clamping loads (e.g., horizontal clamping loads, vertical clamping loads). The threaded portion 47 of the pivot member 33 may be made from a metal (e.g., brass, stainless steel), a polymer, a composite, or any suitable material that is strong enough to withstand the stresses induced by loads generated by the coupling assembly. According to an exemplary embodiment, the pivot member 33 includes the body 46 made from a polymer overmolded (or co-molded) onto the threaded portion 47 that is made from brass. This configuration allows for efficient rotation of the pivot member 33 by having a body 46 with a relative low coefficient of friction and provides strength and durability by having a threaded portion 47 with relative high mechanical properties (e.g., yield strength, tensile strength, etc.).

The pivot member 33 may be configured so that the body 46 fits into the second opening 41 of the clamping member 32. The clamping member 32 may have a retaining feature that is configured to retain the pivot member 33 in position while allowing rotation of the pivot member 33 relative to the clamping member 32. The clamping member 32 may also include a fifth opening 44 that is concentric with the second opening 41, but provided on the opposite side of the clamping member 32 to thereby provide two bearing surfaces about which the pivot member 33 may rotate (or pivot) relative to the clamping member 32. Alternatively, the pivot member 33 may also include a shoulder 48 that extends from one side of the body 46, wherein the shoulder 48 may be configured to have a smaller diameter relative to the diameter of the body 46. The shoulder 48 may be configured to be inserted into the fifth opening 44 of the clamping member 32, which may be configured to have a smaller diameter relative to the diameter of the second opening 41. This configuration allows the pivot member 33 to rotate (or pivot) relative to the clamping member 32 on two bearing surfaces and also retains the lateral position of the pivot member 33 relative to the clamping member 32.

The pivot member 33 may also include an aligning feature that is configured to properly align the threaded insert such that when the adjusting member 34 is inserted through the wall of the pedestal, the threads of the adjusting member 34 find or locate the threads of the insert of the pivot member 33 in order to adjustably couple the adjusting member 34 to the clamping member 32. For example, the shoulder 48 of the pivot member 33 may be configured to have a D-shape as the aligning feature. The fifth opening 44 of the clamping member 32 may be configured as a D-shape with a similar diameter (with clearance to allow for relative rotation), but with the flat of the D positioned farther away from the center of the circular portion (relative to the flat of the D on the shoulder 48) to allow a predetermined degree of rotation in each direction (e.g., clockwise, counterclockwise) of the pivot member 33 relative to the clamping member 32. Alternatively, the fifth opening 44 of the clamping member 32 may include a semi-circular portion that is interrupted by a V-shape portion, which allows the D-shape shoulder 48 to rotate a predetermined amount of angular rotation. Thus, the aligning feature may be configured to allow the pivot member 33 to rotate (within the clamping member 32) the full angular travel represented by angle A formed by the third opening 42 of the clamping member 32 to provide adjustable clamping, but to prevent the pivot member 33 from rotating beyond the third opening 42 to make installation easier.

The threaded portion 51 of the adjusting member 34 may also include a lead-in or any suitable feature that ensures the proper alignment of the threads of the threaded portion 51 with the threads of the threaded portion 47 of the pivot member 33 to prevent cross-threading when the adjusting member 34 is threaded into the pivot member 33. As shown in FIG. 12, the lead-in may be a shoulder portion having an outer diameter that is smaller than the diameter of the threaded portion 51 of the adjusting member 34. The lead-in may vary in length and/or diameter.

Figure 14:
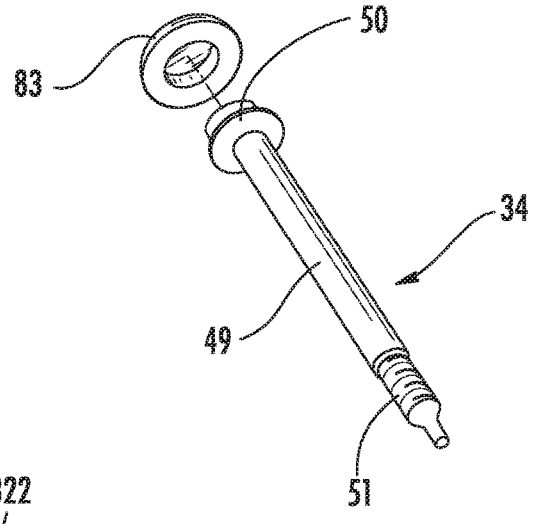
FIG. 14 is a perspective view of an exemplary embodiment of an adjusting member configured for use in a coupling or mounting assembly, such as the coupling assembly shown in FIG. 9.

As shown in FIG. 14, the adjusting member 34 may be cylindrically shaped and may be made from a metal (e.g., brass, stainless steel), a polymer, a composite, or any suitable material that is strong enough to withstand the stresses induced by loads generated by the coupling assembly. According to an exemplary embodiment, the adjusting member 34 is configured as a fastener (e.g., bolt, screw, etc.) having a body 49 and a head 50. The body 49 may be configured to have a threaded portion 51, which may begin on the end opposite the head 50 and may extend along the full length of the body 49 or may extend any length less than the full length of the body 49. The head 50 may include an outer shape (e.g., hexagonal) and/or an inner shape (e.g., hexagonal bore, star slot, Philips or cross slot, flat slot) that are configured to allow a user to input torque through a device (e.g., screwdriver) to turn (or rotate) the adjusting member 34 in order to provide adjustability of the coupling assembly 30. The threaded portion 51 may be configured to have a matching (or mating) thread size (e.g., pitch, diameter) relative to that of the threaded portion 47 of the pivot member 33. The threaded portion 51 may also have a lead to make starting the threads easier.

The toilets 10, 110 may be assembled in place in the washroom using a four step method. The first step includes positioning the seal (e.g., wax ring) and the trap relative to the drain pipe (or soil pipe) and/or the floor of the washroom. The trap 160 may be coupled to the soil pipe with the wax ring (or alternate sealing material or alternate seal device) provided therebetween to form a seal to prohibit leaking. For example, the base of the trap may include one or more openings (e.g., apertures, holes, slots), wherein each opening in the trap is configured to receive a fastener (e.g., bolt, screw, etc.) to clamp the trap to the floor and/or the soil pipe. According to an exemplary embodiment, the base 162 of the trap 160 includes two openings 170, with one opening 170 provided on each side of the base 162 (i.e., one opening 170 on each side of the trap passageway 161) to provide a secure coupling of the trap to the soil pipe and/or the floor of the washroom.

The second step includes coupling (e.g., attaching) the coupling assembly 30 to the trap 160. As shown in FIG. 5, the trap 160 may include walls (e.g., ribs) 167 extending upwardly from the top surface of the base 162, wherein the walls 167 include openings (e.g., apertures, holes, etc.) 168 configured to receive the pin 31 of the coupling assembly 30. Two of the walls 167 may be offset a distance to allow the clamping member 32 to fit between the walls 167, such that the clamping member 32 may pivot or rotate relative to the trap 160. The clamping member 32 of the coupling assembly 30 may be positioned within the walls 167 of the trap 160 such that the openings 168 are substantially concentric with the first opening 40 in the clamping member 32. The pin 31 may be inserted through the openings 168 in the walls 167 of the trap 160, as well as through the first opening 40 of the clamping member 32, to pivotally couple the clamping member 32 to the trap 160. The pin 31 may be inserted until the shoulder 36 contacts a wall 167 (or other stop feature) of the trap, then the pin 31 may be retained in position, such as by inserting a cotter pin (or other securing device) through the opening 37 in the pin 31. It should be noted that the position of the coupling assemblies, such as relative to the trap, may be adjusted (e.g., forward, backward, outside, inside) to accommodate varying parameters (e.g., trap sizes, pedestal widths), which is discussed in more detail below.

The pivot member 33 may be preassembled to the clamping member 32. For example, the pivot member 33 may be pivotally coupled to the clamping member 32 during manufacturing, such that the person installing the toilet does not need to couple the pivot member and the clamping member. Alternatively, the second step may include assembling the pivot member 33 to the clamping member 32, if the pivot member 33 is not preassembled to the clamping member 32. The body 46 of the pivot member 33 may be inserted through the second opening 41 and into the cavity 45 of the clamping member 32, wherein the pivot member 33 may be retained therein, yet free to rotate in the cavity 45 relative to the clamping member 32. The threads of the threaded portion 47 of the pivot member 33 may also be oriented (e.g., aligned) to face in the direction toward the third opening 42 of the clamping member 32 to allow access to the threads of the threaded portion 47 by the threads of the adjusting member 34. For example, the aligning feature discussed above may ensure proper orientation or alignment of the pivot member 33 relative to the clamping member 32. This configuration allows for the person coupling the toilet to the soil pipe and/or the floor, to properly thread (e.g., without cross-threading) the adjusting member 34 into the pivot member 33 with ease, even though this may be a blind coupling (i.e., having little or no visual access of the threads of the threaded portion 47 of the pivot member 33, since they are obscured by the adjusting member and/or the pedestal).

It should be noted that the coupling assembly may include more than one clamping member, such as shown in FIG. 5. For such an embodiment of the coupling assembly, step two may be repeated according to the number of clamping members to thereby pivotally couple each clamping member to the trap.

The coupling assembly 30 may also be configured to retain the clamping member 32 in a position, such as in the upright position shown in FIG. 12 for installation to thereby make assembly of the toilet easier. The clamping member 32 may be retained in such a position using a relative small force, which provides support to the clamping member 32 when the adjusting member 34 is threaded into the pivot member 33. However, the forces generated by the adjustment of the adjusting member 34 (following the initial threading of the adjusting member 34 to the pivot member 33) will overcome the small retaining force to allow the clamping member 32 to pivot about the first opening 40 to properly secure the toilet in place. According to an exemplary embodiment, the coupling assembly 30 may include a spring or biasing member or retaining feature to impart a force to position the clamping member 32 in an upright position, wherein the rotational travel of the clamping member 32 (e.g., in the direction away from the adjacent wall of the pedestal) may be limited to prevent the clamping member 32 from over-rotating beyond the upright position. For example, the clamping member 32 may include a recess that receives a portion (e.g., an end) of a steel spring to provide a biasing force to retain the clamping member 32 in place under low loads (e.g., forces). Following threading of the adjusting member to the pivot member, the force from the biasing member may be overcome by the adjustment of the adjusting member, wherein adjustment of the adjusting member (in the clamping direction) pivots (or rotates) the clamping member (also in the clamping direction).

The third step includes locating the toilet 10, 110 (in particular, its associated pedestal) in place over the trap 60, 160. The third step may also include connecting (e.g., fluidly, structurally) the passageway of the pedestal to the trap passageway 61 of the trap 60, if necessary. For example, the pedestal 21 may be located or positioned over the coupled trap 60 and coupling assembly 30 (e.g., the clamping member, pin, and pivot member), such that the openings 28 in the wall 22 of the pedestal 21 are aligned with the clamping member 32, such as the third opening 42 of the clamping member. Additionally, if needed, the trap passageway and the passageway may be fluidly (and/or structurally) coupled, such as through an elastomeric seal or other suitable coupling, wherein the water (and waste) may pass from the passageway of the pedestal to the trap passageway of the trap.

Figure 7:
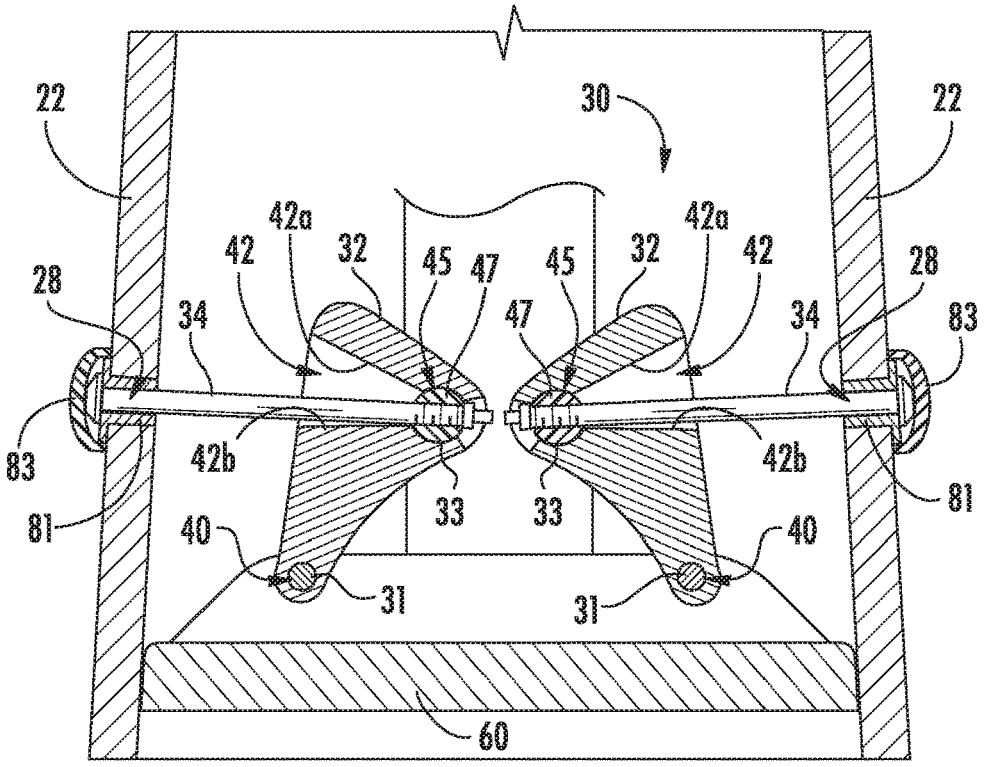
FIG. 7 is a sectional view illustrating the coupling or mounting assembly of FIG. 5 in an unclamped or unlocked position.

The fourth step includes securing the toilet 10 to the trap 60 and/or the soil pipe, through the coupling assembly 30, such as by adjusting the adjusting member 34. With the openings 28 in the wall 22 of the pedestal 21 being aligned with the clamping member 32 (e.g., the third opening 42), one adjusting member 34 may be inserted through each opening 28 in the wall 22 (e.g., right wall 22*a*, left wall 22*b*) to engage the threaded portion 51 of the adjusting member 34 with the threaded portion 47 of the pivot member 33. As shown in FIG. 7, the adjusting member 34 may access the threaded portion 47 through the third opening 42 of the clamping member 32. As the adjusting member 34 is adjusted to provide clamping, such as by rotating the adjusting member in the tightening or clamping direction (e.g., clockwise), the threads of the adjusting member 34 thread along the threads of the threaded portion 47 of the pivot member 33. Because the pivot member 33 is retained by the cavity 45 of the clamping member 32 and the adjusting member 34 is retained by the wall 22 of the pedestal 21, the adjustment of the adjusting member 34 in the clamping direction pulls the threaded portion 47 toward the inside surface of the wall 22 of the pedestal and thereby induces the clamping member 32 to rotate (or pivot) about the first opening 40, such that the upper portion of the clamping member 32 (e.g., second opening 41) moves toward the inside surface of the wall 22 of the pedestal 21. In other words, as the adjusting member 34 is rotated in the clamping (e.g., clockwise) direction, the clamping member rotates about the first opening 40 to change the alignment or orientation of the adjusting member 34 relative to the third opening 42 of the clamping member 32, such as by bringing the adjusting member 34 closer to the top surface 42*a* of the third opening 42 and farther away from the bottom surface 42*b* of the third opening 42.

Figure 8:
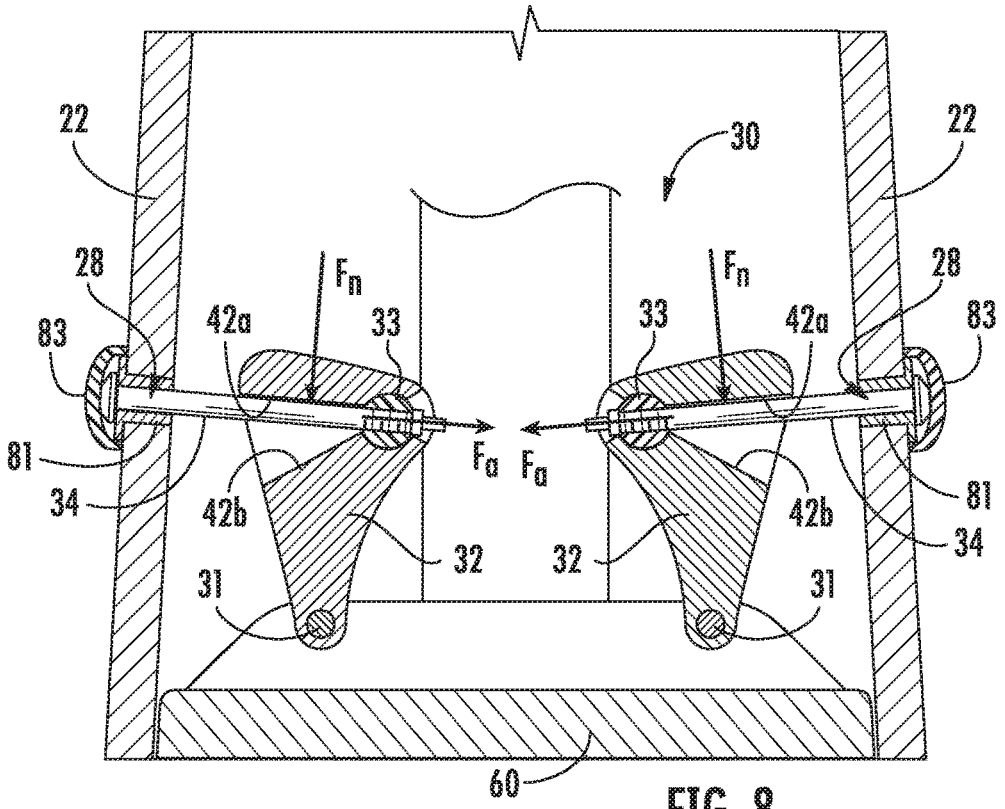
FIG. 8 is a sectional view illustrating the coupling or mounting assembly of FIG. 5 in a clamped or locked position.
Figure 9:
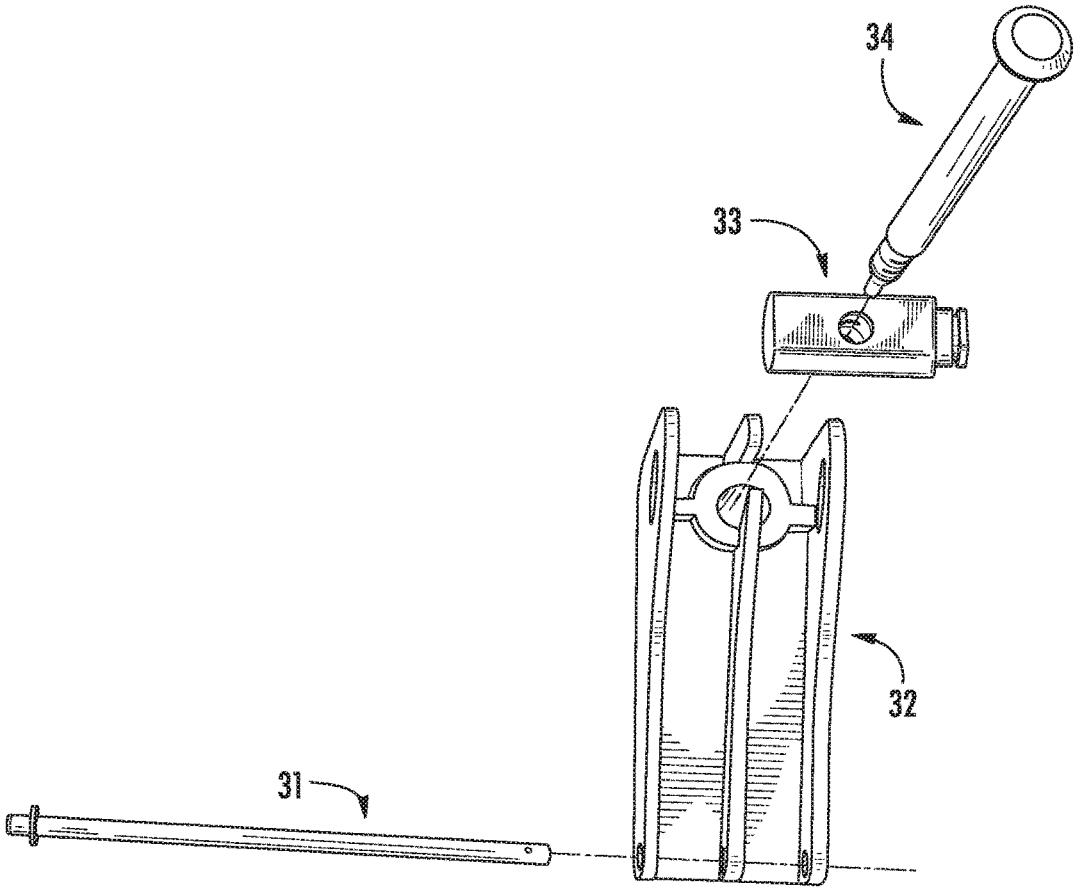
FIG. 9 is a perspective exploded view of an exemplary embodiment of a coupling or mounting assembly for a toilet.

As shown in FIG. 8, after a certain amount of adjustment (e.g., rotation) of the adjusting member 34 in the clamping (e.g., clockwise) direction, at least a portion of the top surface 42*a* of the third opening 42 comes into contact with at least a portion of the adjusting member 34 to thereby impart a normal force Fn into the adjusting member 34. The normal force Fn puts the adjusting member 34 into bending, similar to a simply supported beam. The normal force Fn may include a horizontal component force and a vertical component force to provide clamping forces in both the horizontal and vertical directions. For example, the orientation (e.g., alignment) of the adjusting member relative to horizontal may be varied in order to vary the horizontal and vertical components of the normal force Fn.

Also, once the clamping member 32 (e.g., top surface 42*a* of the third opening 42) is contacting the adjusting member 34, further rotation of the clamping member 32 is prevented (except to remove tolerances, elastic bending or flexing, plastic bending or flexing etc.). Accordingly, additional adjustment of the adjusting member 34 in the clamping direction (after such contact between the clamping member 32 and adjusting member 34) puts the adjusting member 34 in tension (under an increasing tensile load that is a function of the adjustment), which imparts an axial force Fa into the adjusting member 34. The axial force Fa may also include a horizontal component force and a vertical component force to provide clamping forces in both the horizontal and vertical directions, depending on the alignment or orientation of the adjusting member relative to horizontal. The axial force Fa may be adjusted (e.g., by rotating the adjusting member 34) to increase (or decrease) the clamping pressure (e.g., horizontal clamping pressure) that the adjusting member 34 imparts on the wall 22 of the pedestal 21 of the toilet 10. Thus, the clamping pressure securing the toilet (e.g., the pedestal) may be varied by adjusting the adjusting member. In other words, the more the adjusting member is rotated in the clamping (e.g., clockwise) direction, the higher the resulting forces in the horizontal and vertical directions (from the normal force Fn and the axial force Fa) to clamp or secure the toilet (e.g., the pedestal) to the trap, soil pipe, and/or the floor of the washroom.

It should be noted that the geometry of the coupling assembly may vary in order to influence the forces Fa and Fn, which influences the horizontal and vertical forces securing the toilet in place. For example, the relative positions of the first opening 40, second opening 41 and/or third opening 42 of the clamping member 32 may be configured differently (e.g., spaced farther apart, spaced closer together, or a combination thereof) than as shown in the embodiments disclosed herein, in order to influence the forces Fa and Fn. Additionally, other geometric relationships may be changed to influence the forces Fa and Fn, and other geometric relationships may be changed to influence other performance parameters of the coupling assemblies disclosed herein.

The amount of adjustment necessary for the clamping member of the coupling assembly to rotate from an unclamped (or non-locked) position, such as shown in FIG. 7 to a clamped (or locked) position, such as shown in FIG. 8, may vary or may be tailored. For example, the amount of adjustment may vary due to the tolerances in the toilet (e.g., pedestal, coupling assembly, trap, etc.), as well as the tolerances in the soil pipe. As another example, the amount of adjustment may be tailored to accommodate different configurations, such as different configurations of the pedestal and/or trap. Additionally, the coupling assembly (e.g., clamping member, adjusting member) configuration may be changed to tailor the horizontal and vertical forces that secure (e.g., clamp) the pedestal of the toilet to the trap.

The clamping member 32 having a cone shaped third opening 42 may allow the normal force Fn to be distributed over the length of the top surface 42*a* of the third opening 42, as well as over the length of the adjusting member 34 contacting the clamping member 32. This distribution of the force allows the configuration of the coupling assembly 30 (e.g., the clamping member 32, adjusting member 34) to be optimally configured (e.g., thickness, material, cost, etc.) to provide increased clamping force with an improved longevity. For example, a clamping member may be configured to have a point contact or a line of contact, as opposed to a surface of contact, with the adjusting member, which concentrates the force to the point or line, and may accordingly require a change in design, such as in material to increase the mechanical properties, to accommodate the stress concentration that results. The distribution of force (or pressure) ameliorates the issues associated with stress concentrations.

According to an exemplary embodiment, the trap of the toilet may be configured to accommodate varying width toilets. Accordingly, the same trap may be used to couple more than one model of toilet with each toilet having different widths (e.g., distance between the walls of the pedestal such as the distance between 22*a* and 22*b* shown in FIG. 5). In order to accommodate varying widths of the pedestals, the trap may be configured to include one or a plurality of openings (e.g., holes) configured in one or a plurality of ribs (e.g., walls) that extend from the base of the trap. The trap may also be configured to include a plurality of ribs, with each rib having one or a plurality of openings that align with one or more openings provided on other ribs.

Figure 15:
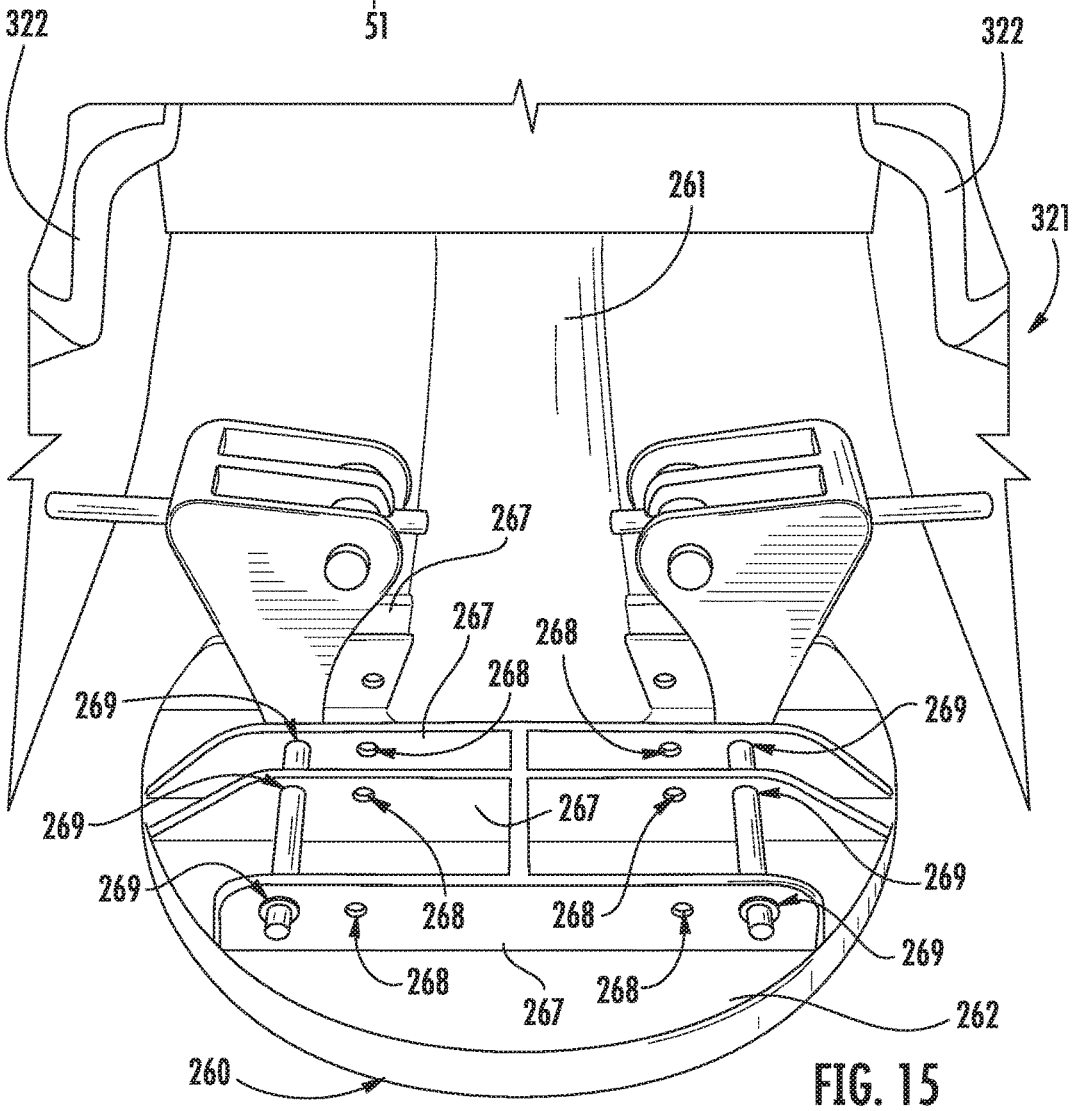
FIG. 15 is a perspective view illustrating a coupling or mounting assembly coupling a pedestal having a wider base to a trap.
Figure 16:
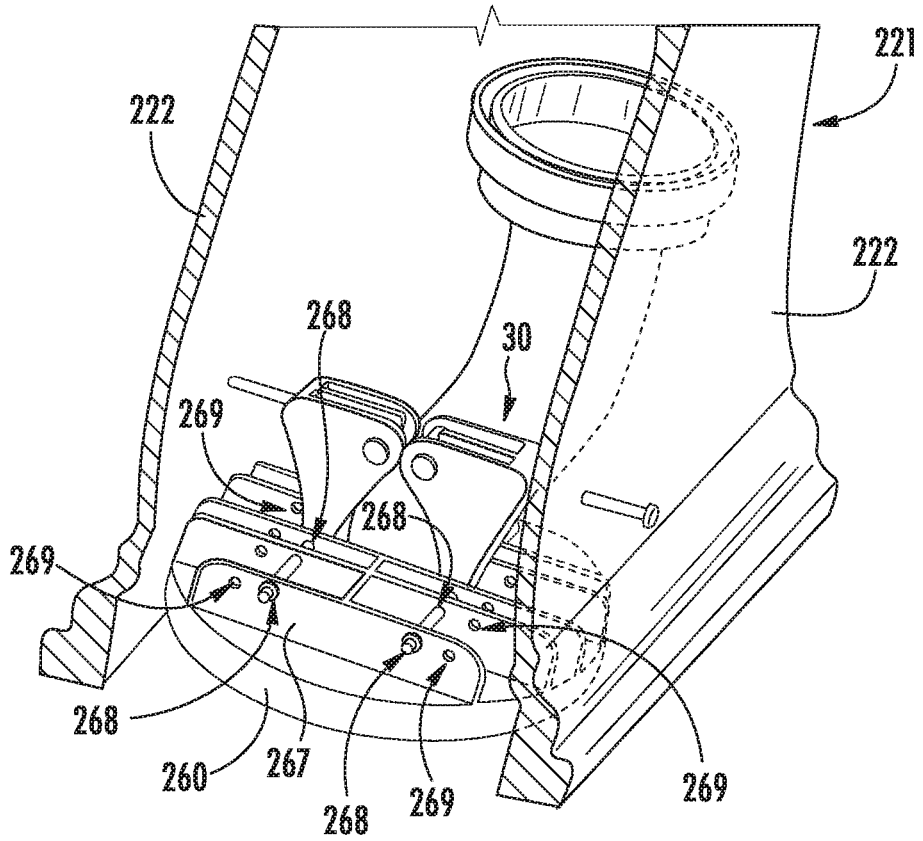
FIG. 16 is a perspective view illustrating a coupling or mounting assembly coupling a pedestal having a narrower base to a trap.
Figure 17:
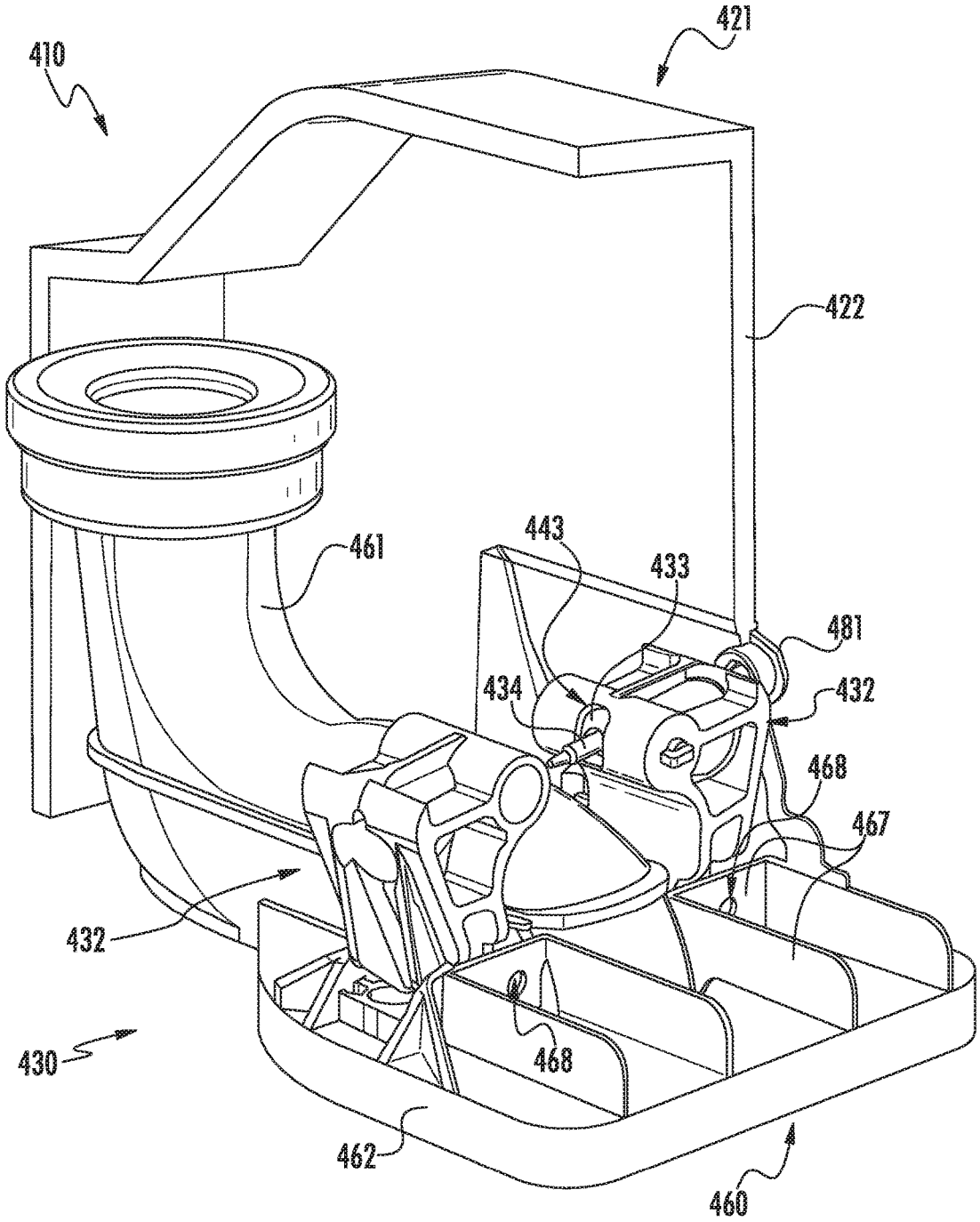
FIG. 17 is a side perspective view of another exemplary embodiment of a coupling or mounting assembly shown coupling the pedestal of the toilet to a trap.
Figure 18:
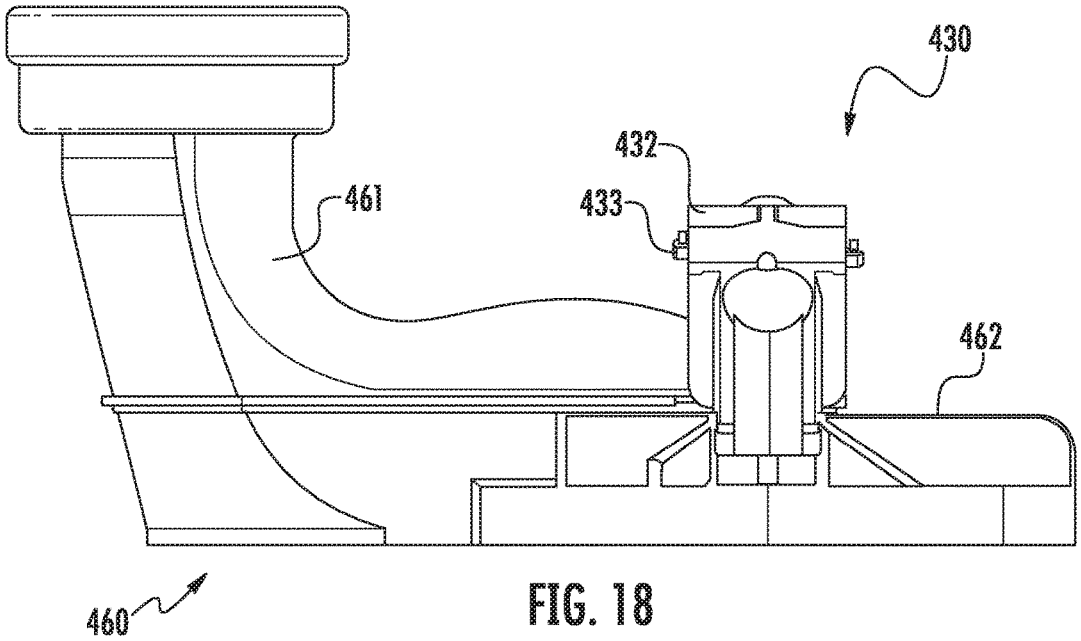
FIG. 18 is a side view of the coupling assembly of FIG. 17 shown coupled to a trap.
Figure 19:
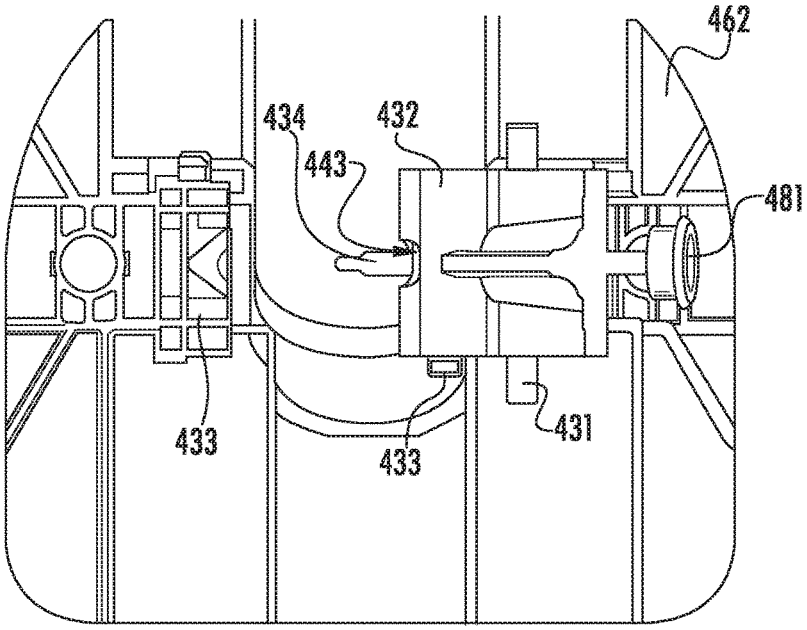
FIG. 19 is a top view of the coupling assembly of FIG. 17 shown coupled to a trap.
Figure 20:
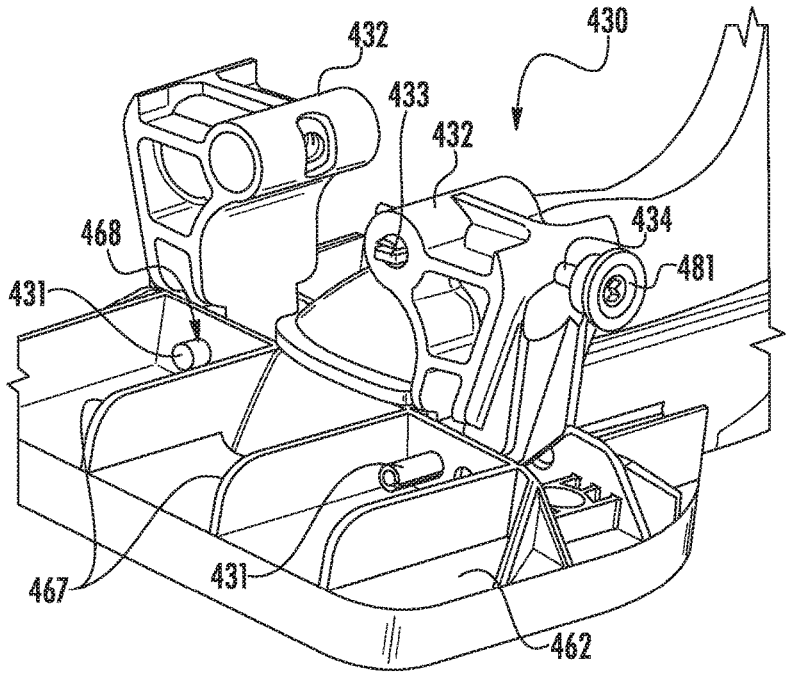
FIG. 20 is a perspective view of a portion of the coupling assembly of FIG. 17 shown coupled to a trap.
Figure 21:
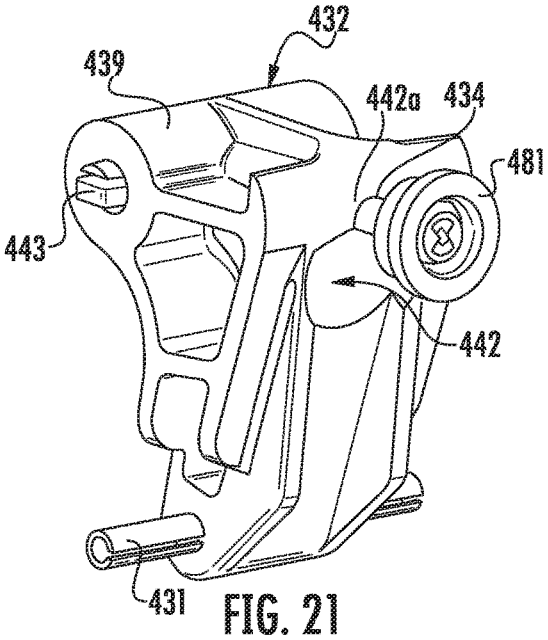
FIG. 21 is another perspective view of a portion of the coupling assembly of FIG. 17.
Figure 22:
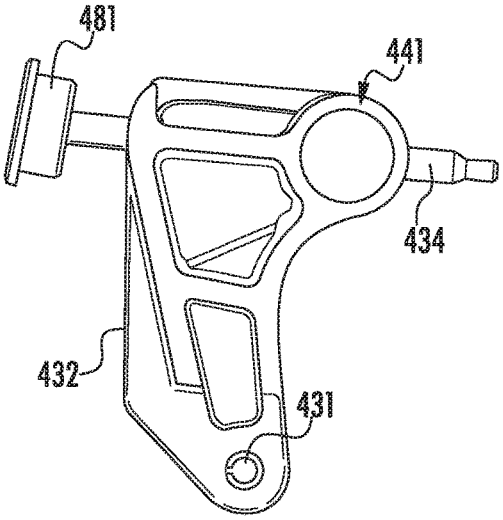
FIG. 22 is a front view of the portion of the coupling assembly of FIG. 21.
Figure 23:
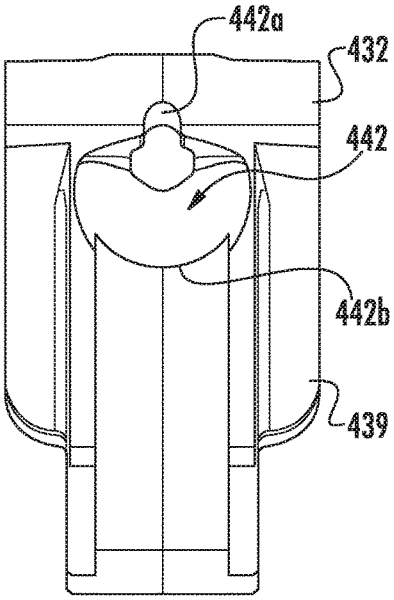
FIG. 23 is a side view of another exemplary embodiment of a clamping member.
Figure 24:
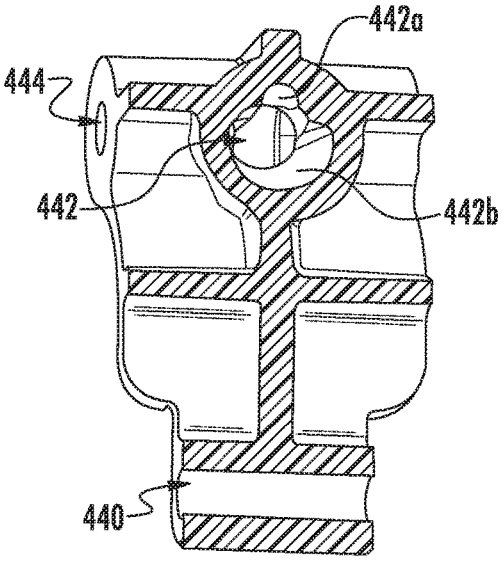
FIG. 24 is a sectional view of the clamping member of FIG. 23.

According to an exemplary embodiment shown in FIGS. 15 and 16, the trap 260 may include a trap passageway 261 extending from a base 262, wherein the base 262 is configured to include a plurality of ribs 267 with each rib 267 having a first (or inner) set of holes 268 and a second (or outer) set of holes 269. As shown in FIG. 16, the first (or inner) set of holes 268 may be used to couple a toilet having a pedestal 221 that is narrow (i.e., the distance between the walls 222 is relatively small) through a coupling assembly 30. As shown in FIG. 15, the second (or outer) set of holes 269 may be used to couple a toilet having a pedestal 321 that is wide (i.e., the distance between the walls 322 is relatively large) through a coupling assembly 30. It should be noted that the trap may include any number of sets of holes (e.g., openings) to provide coupling of any width toilet to the trap and/or the soil pipe through the coupling assembly 30, and the embodiments disclosed herein are not meant as limitations.

FIGS. 17-20 illustrate another exemplary embodiment of a mounting or coupling assembly 430 configured to secure the pedestal 421 of the toilet 410 to the trap 460. As shown, two coupling assemblies 430 are provided on opposing sides of the trap 460 in order to secure two opposing side walls 422 to the trap 460 and/or to the floor. The trap 460 may be configured the same as, similar to, or different from the other traps (e.g., the trap 60, the trap 260) disclosed herein. For example, the trap 460 may include a base 462 and a passageway 461 that extends from the base 462 and is in fluid communication with the toilet 410, such as with the bowl through a trapway. The base 462 may include a plurality of ribs 467, where each rib 467 has one or more than one hole 468 provided therein. For example, each hole 468 may receive the pin 431 in which the clamping member 432 is configured to pivot about.

As shown, each coupling assembly 430 includes a pin 431 configured to engage the base 462, a clamping member 432 pivotally coupled to the pin 431, a pivot member 433, and an adjusting member 434. The pivot member 433 may be disposed in a cavity of the clamping member 432, such that the clamping member 432 retains the pivot member 433, yet the pivot member 433 is free to rotate in the cavity relative to clamping member 432. The adjusting member 434 is configured to engage the pivot member 433, such that the adjusting member 434 is adjustably restrained by the pivot member 433.

FIGS. 21-26 illustrate another exemplary embodiment of a clamping member 432. The clamping member 432 may be configured generally as described herein for other clamping members (e.g., the clamping member 32). The clamping member 432 may include a body 439 defining a cavity 445 and having a plurality of openings or holes provided therein. For example, the clamping member 432 may include a first opening 440 configured to receive the pin 431 and a second opening 441 configured to allow the pivot member 433 to be inserted into the cavity 445 through the second opening 441 to be retained in the cavity 445. The clamping member 432 may also include a third opening 442, a fourth opening 443, and/or a fifth opening 444.

The third opening 442 of the clamping member 432 may be configured having any suitable shape that may receive the adjusting member 434 therein. For example, the third opening 442 may have a generally conical shape that is defined by a surface with a slot provided therein. As shown, the slot may be defined by a curved upper surface 442*a* and the conical portion of the third opening 442 may be defined by a surface 442*b*. The slot may be configured with side walls that extend generally downward from the ends of the curved upper surface 442*a* to define an elongated slot. The width of the slot of the third opening 442 may be configured to receive the shank 434*a* of the adjusting member 434 therein, such as when the coupling assembly 430 is securing the pedestal 421 to the fixture (e.g., drain pipe, floor, etc.). This arrangement may capture the shank 434*a* in the slot and therefore support the shank 434*a* on multiple sides thereby reducing the degrees of freedom between the adjusting member 434 and the clamping member 432. This arrangement may advantageously increase the amount of lock-up to provide a stronger connection by the coupling assembly 430 to the pedestal 421 and the fixture. In other words, this arrangement may advantageously reduce the likelihood of movement (e.g., lateral, fore-aft) of the pedestal 421, such as the nose of the pedestal during use of the toilet, after being secured to the fixture.

The fourth opening 443 of the clamping member 432 may be provided on a side of the body 439 opposing the third opening 442, where the fourth opening 443 allows for the shank 434*a* of the adjusting member 434 to pass through, such as during adjustment of the adjusting member 434 to secure the pedestal 421 of the toilet 410 to the fixture. Accordingly, the fourth opening 443 may have any suitable shape and size, which may be tailored to the shape and size of the shank 434*a* along with any necessary clearance to accommodate the relative movement between the clamping member 432 and the adjusting member 434.

The fifth opening 444 of the clamping member 432 may be provided on a side of the body 439 opposing the second opening 441, such as to allow a portion (e.g., an end portion) of the pivot member 433 to pass through the fifth opening 444. The fifth opening 444 may have any suitable shape and size. As shown, the fifth opening 444 is configured as a generally round opening having a diameter that is smaller than the diameter of the second opening 441. This may advantageously allow the pivot member 433 to be inserted into the cavity 445 through the second opening 441, such that the fifth opening 444 receives a locking end of the pivot member 433 to allow relative rotation between the pivot member 433 and the clamping member 432 about a pivot axis, while preventing displacement of the pivot member 433 relative to the clamping member 432 along the pivot axis.

Figure 25:
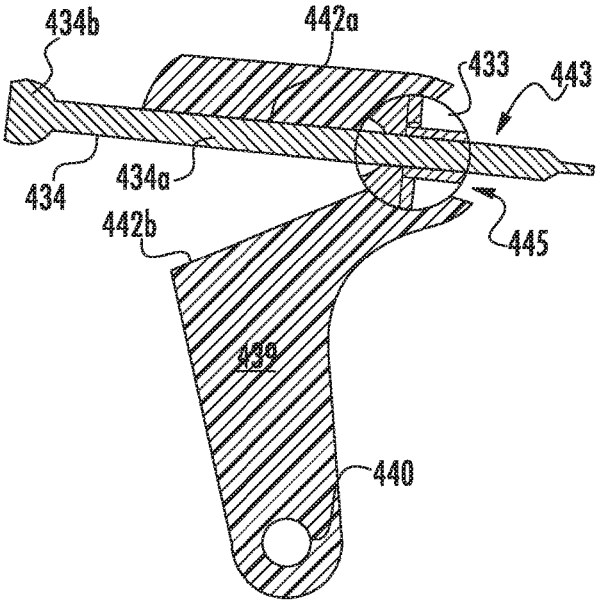
FIG. 25 is a sectional of the portion of the coupling assembly of FIG. 21.
Figure 26:
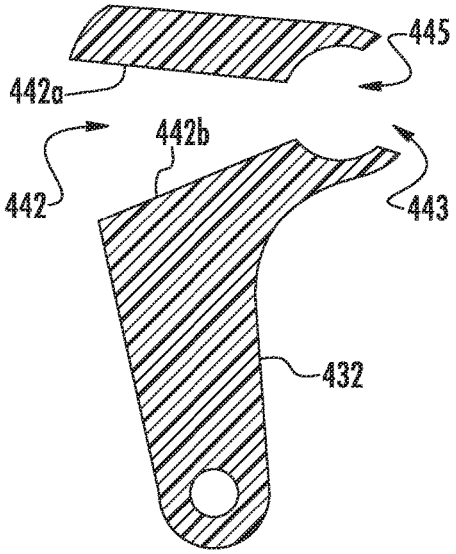
FIG. 26 is another sectional view of the clamping member of FIG. 23.
Figure 28:
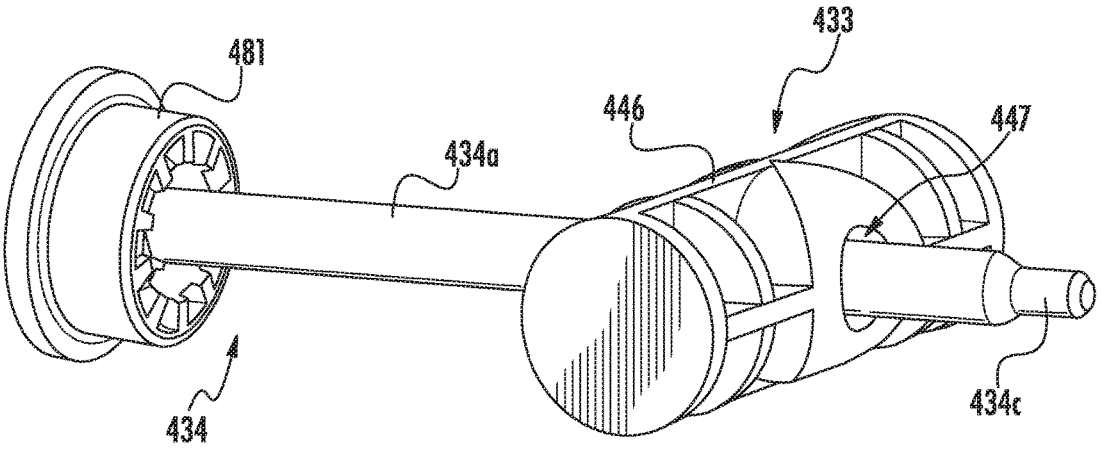
FIG. 28 is a perspective view of the adjusting member and pivot member of FIG. 27.

The pivot member 433 may be configured generally as described herein for other pivot members (e.g., the pivot member 33). The pivot member 433 is configured to be pivotally coupled to the clamping member 432. The pivot member 433 may have any suitable shape and size. As shown in FIGS. 25 and 28, the pivot member 433 includes a cylindrical body 446 that is configured to be disposed in the cavity 445 of the clamping member 432, where the outside surface of the body 446 acts as a bearing surface during relative rotation between the pivot member 433 and the clamping member 432. The cylindrical body 446 may define a pivot axis for the pivot member 433 to rotate about relative to the clamping member 432. The size (e.g., outer diameter) of the body 446 may be tailored to pass through the second opening 441 of the clamping member 432.

Figure 27:
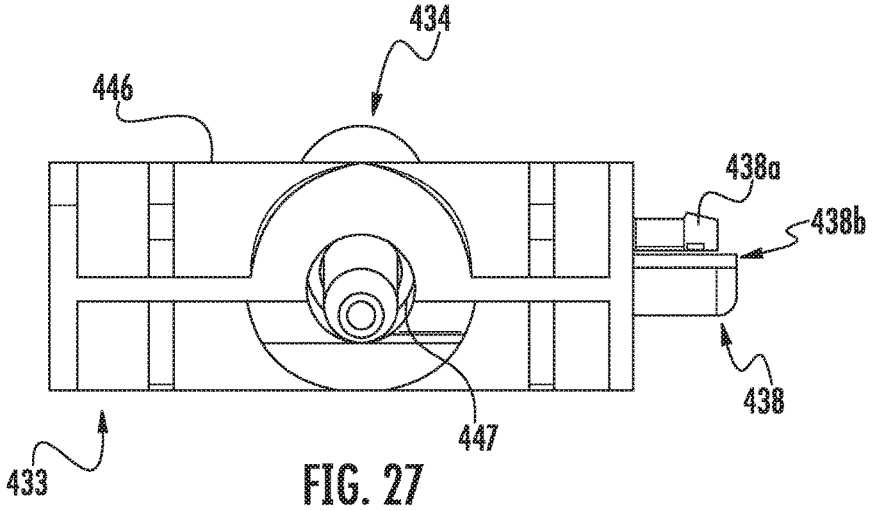
FIG. 27 is a side view of an adjusting member engaging a pivot member, according to another exemplary embodiment.

The pivot member 433 may also include a locking feature configured to pivotally couple the pivot member 433 to the clamping member 432. As shown in FIG. 27, the locking feature is configured as a generally cylindrical snap 438 having a detent 438*a*, which may be configured to pass through the fifth opening 444 and to engage an outer surface of the body 439 of the clamping member 432, such as to prevent relative lateral movement (e.g., along the pivot axis) between the pivot member 433 and clamping member 432. The detent 438*a* may have an outer size (e.g., diameter) that is configured to be larger than the fifth opening 444 of the clamping member 432 to provide an interference fit while passing therethrough, yet the detent 438*a* may be flexible to allow it to deform during assembly, then return to its natural (e.g., pre-deformed) state to pivotally couple the pivot member 433 to the clamping member 432. The snap 438 may also have a notch 438*b* (e.g., channel, slot, groove, etc.) that may generally divide the snap 438 into two portions. The notch 438*b* is configured to allow the detent 438*a* to flex along with the portion on which the detent 438*a* is disposed, such as during assembly.

The pivot member 433 includes a feature to adjustably couple the adjusting member 434 to the pivot member 433. For example, the body 446 of the pivot member 433 includes an internal threaded opening 447 that is configured to receive mating external threads of the shank 434*a* of the adjusting member 434. However, it should be noted that the pivot member 433 may include any suitable feature that couples (e.g., adjustably couples) the adjusting member 434 to the pivot member 433.

As shown in FIGS. 25, 27, and 28, the adjusting member 434 includes a shank 434*a* and a head 434*b*. The shank 434*a* has a first end and a second end, where the first end of the shank 434*a* is configured to pass through the clamping member 432 (e.g., the third opening 442), such as to engage the pivot member 433. The second end of the shank 434*a* is configured to engage the head 434*b* of the adjusting member 434. The head 434*b* may pivot (i.e., has some rotational freedom) relative to another member, such as a bushing or end cap, to allow for the alignment of the shank 434*a* to be varied. This arrangement may advantageously improve assembly, such as by allowing the head 434*b* to maintain a relatively fixed position that is retained by the bushing for the installer to manipulate, while allowing the alignment (e.g., the angle of insertion) of the shank 434*a* to be varied to properly engage the pivot member 433.

The shank 434*a* may also include a lead-in feature to help facilitate coupling the adjusting member 434 to the pivot member 433, such as during installation of the pedestal to the fixture. As shown in FIG. 28, the lead-in feature is configured as shoulder 434*c* having a smaller diameter relative to the diameter of the shank 434*a*. However, the lead-in may have any suitable configuration (e.g., size, shape), such as being a tapered portion extending from the shank 434*a*.

The coupling assembly 430 may also include a connecting feature that is configured to retain the head 434*b* of the adjusting member 434 with respect to the opening 28 in the wall 22 of the pedestal 21. As shown, the connecting feature is configured as a bushing 481 having a body that is configured to engage the opening 28 in the wall 22 and a head that is configured to abut the outer surface of the wall 22. In other words, the body of the bushing 481 acts as a bearing surface (although not necessarily for pivoting purposes) to distribute loading from the adjusting member 434 to the pedestal 21 through the contact surface of the wall 22, and the head of the bushing 481 limits movement of the bushing 481 (and the adjusting member 434) in the direction toward the wall 22. The bushing 481 may include a recess that is configured to receive the adjusting member 434, such as the head 434*b* of the adjusting member 434, to retain the coupled adjusting member 434 and bushing 481 to the wall 22 of the pedestal 21. For example, the recess of the bushing 481 may be configured so that there is an interference fit between the head 434*b* and the inner surface of the body of the bushing 481, such that once the head 434*b* is pressed into place into the recess, the inner surface of the body prohibits the head 434*b* from passing back out of the recess.

The head 434*b* of the adjusting member 434 may be configured to have a diameter that is larger than the diameter of the opening 28 in the wall 22 of the pedestal 21 and/or that is larger than an inner diameter of the body of the bushing 481, so that the adjusting member 434 may impart clamp forces (e.g., horizontal forces, vertical forces) into the wall 22 directly or indirectly through the bushing 481. For example, once the coupling assembly 430 is installed to secure the pedestal 21 to the trap and floor, adjustment (e.g., rotation) of the adjusting member 434 is configured to move the pivot member 433 along the shank 434*a* of the adjusting member 434, where the movement of the pivot member 433 in turn pivots the clamping member 432 relative to the trap 460. The clamping member 432 may pivot between a first position in which a portion (e.g., the upper surface 442*a*) of the clamping member 432 contacts the adjusting member 434 (e.g., to thereby load the shank 434*a*) to secure the pedestal 421 to the trap 460 and a second position in which the portion of the clamping member 432 does not contact the adjusting member 434.

When the clamping member is in the first position and the upper surface 442*a* of the clamping member 432 contacts the adjusting member 434, a normal force Fn is imparted from the clamping member 432 to the adjusting member 434, which is transferred through the adjusting member 434 and/or the bushing 481 to the wall 22 of the pedestal 21. The normal force Fn acts to secure (e.g., clamp) the pedestal to the trap and/or floor. The normal force Fn may be varied by adjustment of the adjusting member 434, such as to increase the clamping force between the pedestal 21 and the trap and/or floor. When the clamping member 432 contacts the adjusting member 434, this contact acts to prohibit additional pivoting of the clamping member 432, which in turn acts to maintain the relative position or location of the pivot member 433. This arrangement induces an axial force Fa that is directed along the longitudinal axis of the shank 434*a* of the adjusting member 434. Accordingly, additional adjustment of the adjusting member 434 in the tightening direction increases the axial force Fa since the relative position of the pivot member 433 is restrained (e.g., relatively fixed) and the threaded engagement between the adjusting member 434 and pivot member 433 moves the pivot member 433 along the adjusting member 433. In other words, since the head 434*b* of the adjusting member 434 is fixed (e.g., in the lateral direction) by the wall 22 and/or the bushing 481 and the pivot member 433 is relatively fixed due to the contact between the clamping member 432 and the adjusting member 433, an increasing tension force in the shank 434*a* is induced by additional adjustment (e.g., tightening) that increases the axial force Fa. The axial force Fa is transferred to the wall 22 to secure the pedestal 21 in the lateral direction, while the normal force Fn is transferred to the wall 22 to secure the pedestal 21 in the vertical direction.

Additionally, the toilets having coupling assemblies disclosed herein may be configured to couple the trap and/or soil pipe to the toilets having varying offset distances (i.e., the distance between the passageway of the soil pipe and the rear wall provided behind the toilet of the washroom). For example, some toilets are configured to have a ten inch (10 in.) offset distance, having approximately ten inches in length between the centerline of the passageway of the soil pipe and the rear wall. Other toilets are configured to have twelve inch (12 in.) or fourteen inch (14 in.) offset distances. The coupling assemblies disclosed herein may be used to couple toilets to traps configured with any offset distance (e.g., 10 in., 12 in., 14 in., etc.). The coupling assemblies disclosed herein allow for the flexibility to couple any trap (e.g., 10 in., 12 in., 14 in.) to any toilet and allow for a single toilet model to couple these alternate soil pipe passageway offset distances.

As shown in FIGS. 7 and 8, the coupling assembly may also include a bearing device 81 provided in the wall of the pedestal of the toilet to provide a bearing surface that the adjusting member may rotate within. The bearing device 81 may also absorb loads that are induced by the adjusting member, such as loads that otherwise would be imparted into the surface of the opening of the wall of the pedestal.

As shown in FIGS. 7 and 8, the coupling assembly may also include a cap 83, which may be configured to surround the head of the adjusting member to improve the aesthetics. Accordingly, the aesthetic cap 83 may visually blend in with the wall of the pedestal, such as by having substantially the same color and/or texture as the wall, to thereby hide the head of the adjusting member, which may be configured having a color and/or texture that is dissimilar to the wall of the pedestal.

Figure 33:
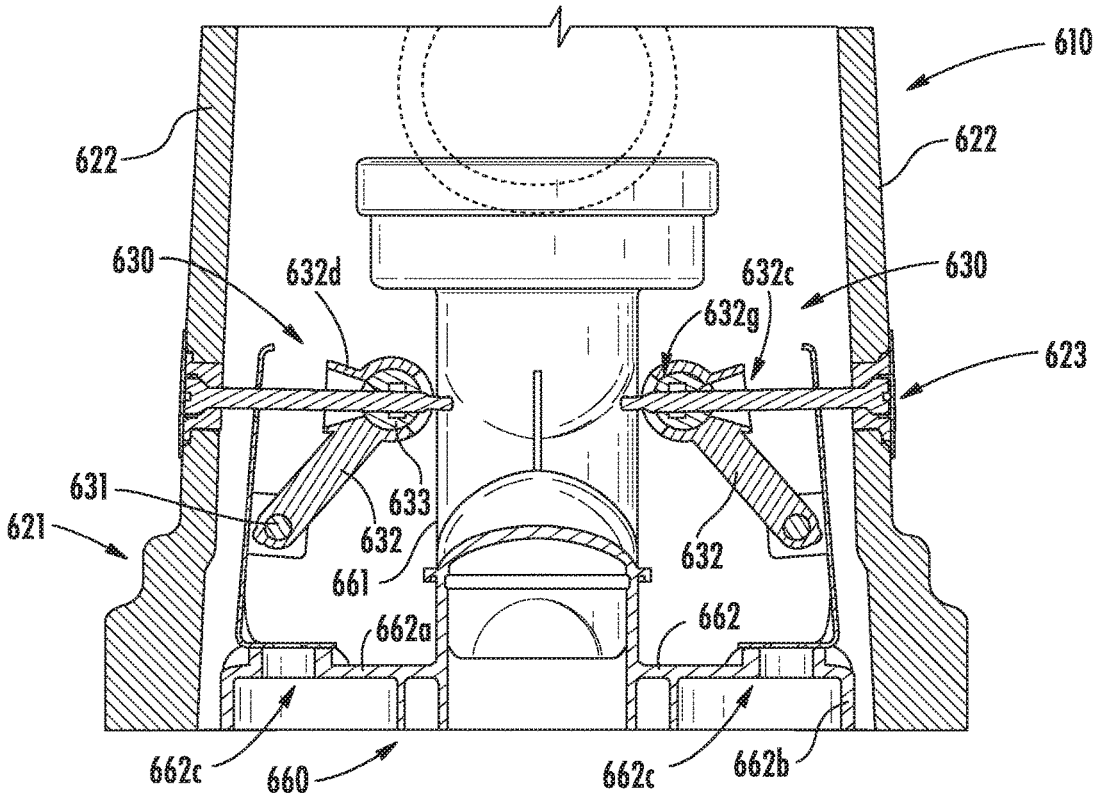
FIG. 33 is a front sectional view of the coupling assembly of FIG. 29 coupled to a pedestal and the trap.

FIGS. 29-38 illustrate another exemplary embodiment of a mounting assembly 630 (e.g., coupling assembly, attachment assembly, etc.) configured to adjustably couple the pedestal 621 of the toilet 610 to the trap 660 (and secure the pedestal 621 to the floor). The toilet 610 may utilize one or more than one mounting assembly 630 to secure the pedestal 621 in place, such as to the trap 660 and/or the floor. As shown in FIG. 33, the toilet 610 includes two mounting assemblies 630 provided on opposite sides of the trap 660, such that the two mounting assemblies 630 are configured to engage opposing walls 622 (e.g., side walls) of the pedestal 621 to secure both sides of the pedestal 621 to both sides of the trap 660.

Figure 30:
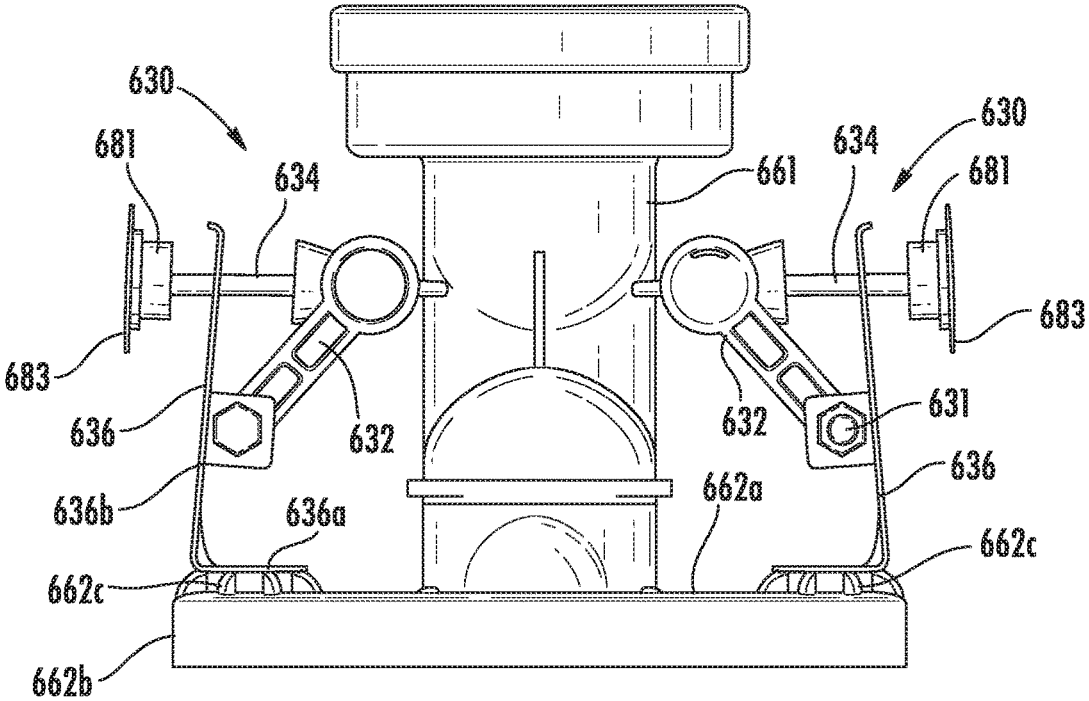
FIG. 30 is a front view of the coupling assembly and trap of FIG. 29.
Figure 31:
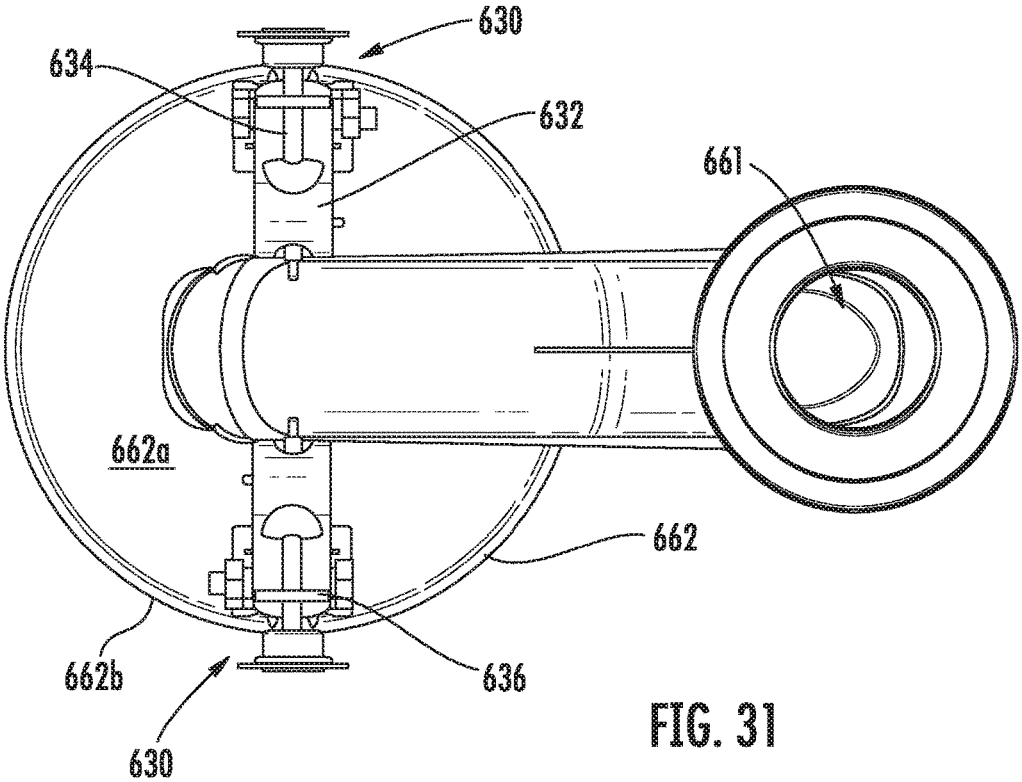
FIG. 31 is a top view of the coupling assembly and trap of FIG. 29.
Figure 32:
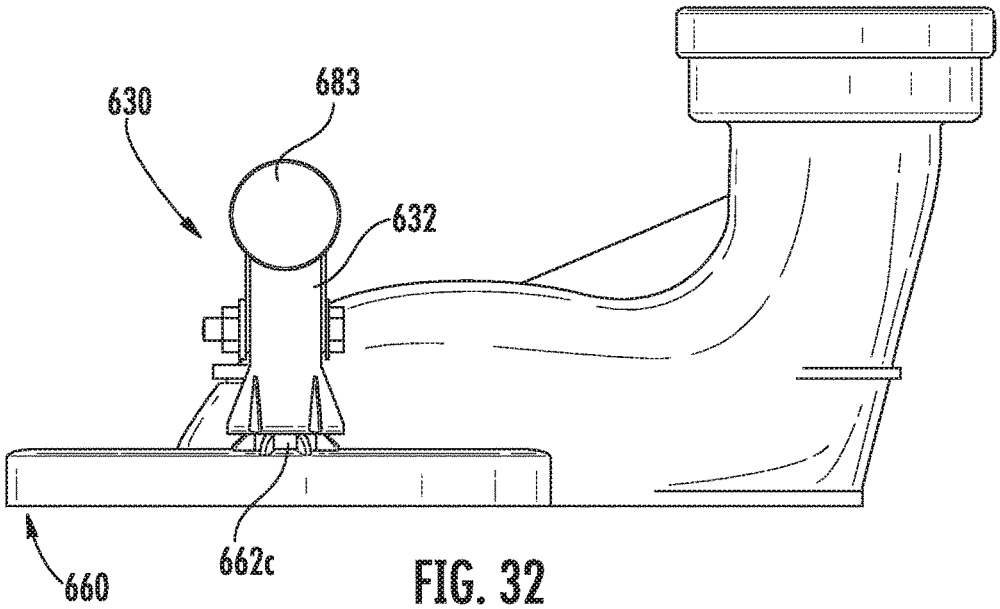
FIG. 32 is a side view of the coupling assembly and trap of FIG. 29.

The trap 660 may be configured the same as, similar to, or different from the other traps (e.g., the trap 60, the trap 260, etc.) disclosed herein. For example, the trap 660 may include a base 662 and a passageway 661 that extends from the base 662 and is in fluid communication with the toilet 610, such as with the bowl through a trapway and with a soil pipe (e.g., the soil pipe 601 shown in FIG. 34). The base 662 is configured as a cylindrical cap having a circular top member 662*a* and an annular side wall 662*b* that extends downward from the top member 662*a*. The base 662 may also include a mount 662*c* for connecting the mounting assembly 630 to the trap 660. As shown in FIG. 30, the base 662 includes two mounts 662*c* provided on opposite sides (e.g., a left-side and a right-side) of the passageway 661, where each mount 662*c* is configured to connect one mounting assembly 630 to the trap 660, such as through a fastener (e.g., screw, bolt, etc.). Each mount 662*c* includes a feature to connect at least one mounting assembly 630. For example, each mount 662*c* may include an opening (e.g., aperture, hole) that is configured to receive a fastener to connect the trap 660 and the mounting assembly 630. Additionally, each mount 662*c* may be configured as a raised surface, an emboss, a projection, or another feature that can support the one or more than one mounting assembly 630. As shown, the two mounts 662*c* are configured to be provided near the outer periphery of the base 662 in order to position the mounting assemblies 630 near the side walls 622 of the pedestal 621.

Figure 34:
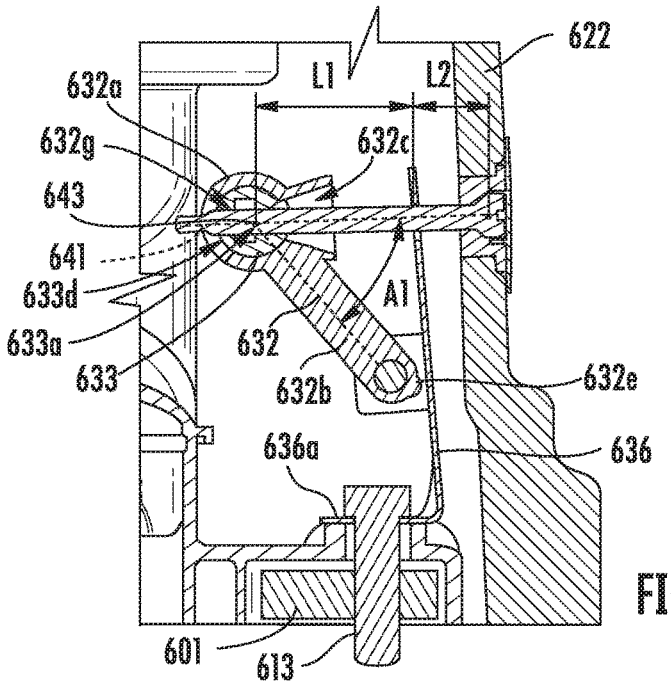
FIG. 34 is a partial view of the front sectional view of FIG. 33 with the clamping member configured in a nominal position.
Figure 38:
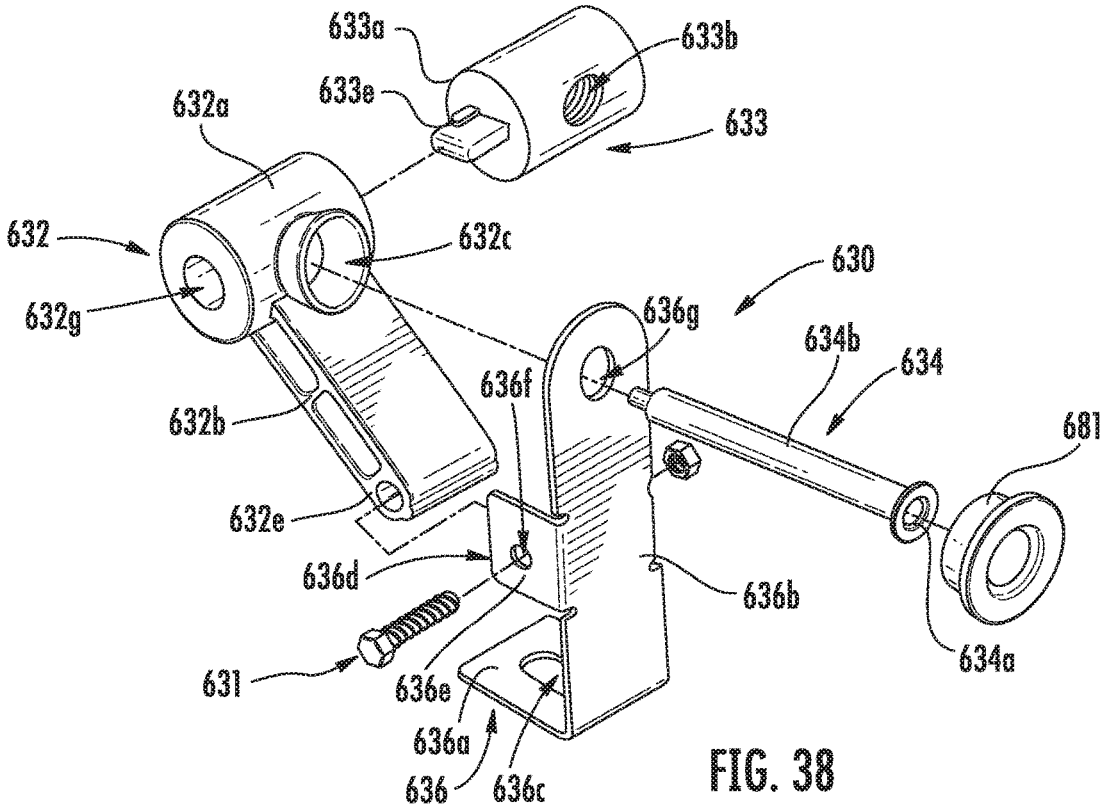
FIG. 38 is an exploded perspective view of the coupling assembly of FIG. 37.

Each mounting assembly 630 includes a clamping member 632, an adjusting member 634, and a support member 636. The support member 636 may be coupled to the trap 660, such as through a fastener. As shown in FIG. 34, each mounting assembly 630 may be coupled to the trap 660 using a fastener 613, which also is configured to couple the trap 660 to the soil pipe 601 (e.g., drain pipe). This arrangement may advantageously reduce the number of components of the mounting assembly 630, as well as improve the strength and load management provided by the mounting assembly 630, as discussed below in more detail. Alternatively, the support member 636 may be coupled to the trap 660 at other locations (i.e., locations other than the connection between the trap and the soil pipe). The clamping member 632 may be pivotally coupled to the support member 636, and may include a bore configured to receive the adjusting member 634, such that actuation of the adjusting member 634 moves (e.g., pivots) the clamping member 632 relative to the support member 636. The adjusting member 634 may extend through an opening 623 in the pedestal 621, such as in the wall 622 of the pedestal 621 as shown in FIG. 33, through an opening 636*g* in the support member 636 as shown in FIG. 38, and into the bore 632*c* of the clamping member 632. The adjusting member 634 may also engage a pivot member (e.g., a second pivot member 633), if the pivot member is provided in the mounting assembly. Thus, the adjustment (e.g., rotation) of the adjusting member 634 may drive pivoting of the clamping member 632 relative to the support member 636 to create a clamping load.

The clamping member 632 may be configured similar to, the same as, or different than the other clamping members disclosed herein. As shown in FIGS. 29-38, the clamping member 632 includes a body portion 632*a* and a pivot arm 632*b* that extends away from the body portion 632*a*. Each element of the clamping member 632 (e.g., the body portion, pivot arm, etc.) may be integrally formed as a one-piece or unitary component, or may be formed separately then coupled together. The clamping member 632 is configured to receive the adjusting member 634. For example, the body portion 632*a* may include a first bore 632*c* that is configured to receive the adjusting member 634 therethrough. The clamping member 632 may also include a receiving portion 632*d* that receives the adjusting member 634. The first bore 632*c* may include more than one portion (e.g., section), such as, for example, first and second portions. As shown in FIGS. 33-36, the first bore 632*c* is defined by and extends through both the body portion 632*a* and a receiving portion 632*d* of the clamping member 632. Thus, the first bore 632*c* may include a first portion, which is generally cylindrical shaped and extends through the body portion 632*a*, and may include a second portion, which is generally fusto-conical shaped and extends through the receiving portion 632*d*.

Figure 36:
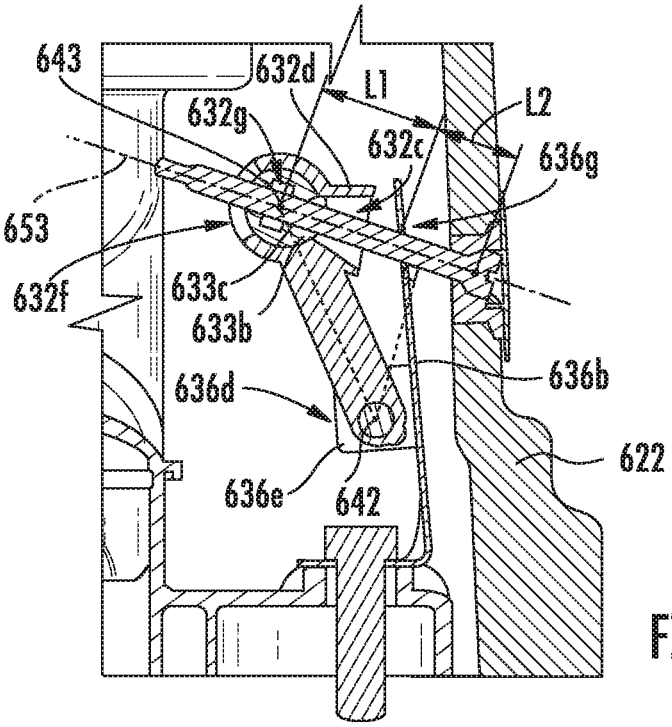
FIG. 36 is a front sectional view of the coupling assembly of FIG. 34 with the clamping member configured in a second (e.g., fully retracted) position.

The first bore 632*c* may include additional portions. As shown in FIG. 36, the first bore 632*c* includes a third portion 632*f*, which is semi-conical shaped and extends from the first portion of the first bore 632*c* in an opposite direction relative to the direction of the second portion. The third portion 632*f* may allow a portion (e.g., an end) of the adjusting member 634 to extend beyond the clamping member 632, and the semi-conical shape may allow for rotation of the adjusting member 634 relative to the clamping member 632. The first bore 632*c* is configured to extend in a first direction 641 through the clamping member 632, which may be a relatively lateral direction when in a nominal design position, as shown in FIG. 34. However, it is noted that the first bore 632*c* may be configured having other suitable shapes that receive the adjusting member 634 and allow the clamping member 632 to pivot, such as, for example, relative to the support member 636 and/or the adjusting member 634 to help tailor the clamping forces (e.g., horizontal forces, vertical forces).

The pivot arm 632*b* extends away from the body 632*a* to a distal end 632*e* that is configured to be pivotally connected to the support member 636. As shown in FIG. 34, the pivot arm 632*b* may extend at an angle A1 relative to the first direction 641. The angle A1 may be configured to move the distal end 632*e* closer to, such as proximate to, a portion of the support member 636 and/or the wall 622 of the pedestal 621, which may advantageously allow for an improved clamping ratio, as discussed below. Accordingly, the angle A1 may be tailored to accommodate different toilet configurations to tailor the clamping ratio. In other words, the ideal angle A1 is based on the specific toilet configuration, such as, the width of the pedestal, and therefore the specific angle may be tailored to accommodate different designs. The angle A1 may also help arrange the adjusting member 634 with a generally horizontal alignment in the nominal position, which may advantageously make it easier for installation of the mounting assembly.

The adjusting member 634 may be configured similar to, the same as, or different than the other adjusting members disclosed herein. For example, the adjusting member 634 may be configured generally the same as the adjusting member 34. The adjusting member 634 may include a head 634*a* and a shank 634*b* that extends away from the head 634*a*. The shank 634*b* may be threaded (completely or partially). The shank 634*b* may include a lead-in feature, such as, for example, a smaller diameter end 634*c*, which may help facilitate inserting the end 634*c* into the first bore 632*c* and/or a pivot member (e.g., the second pivot member 633), since the insertion of the end 634*c* into the first bore 632*c* may be a relatively blind process with the coupling being on the inside of the vitreous wall 622 of the pedestal. Each element of the adjusting member 634 (e.g., the shank, head, etc.) may be integrally formed as a one-piece or unitary component, or may be formed separately then coupled together.

The length of the adjusting member 634 may be changed as well, such as, depending on the width of the pedestal being secured. For example, if a wider pedestal is used, then a relatively longer adjusting member 634 may be used as well, which may increase the clamping ratio (e.g., to a ratio of 5:1 or higher). However, the longer adjusting member 634 may increase cost, such as by increasing the piece cost and/or driving additional cost from introducing additional variants.

Figure 29:
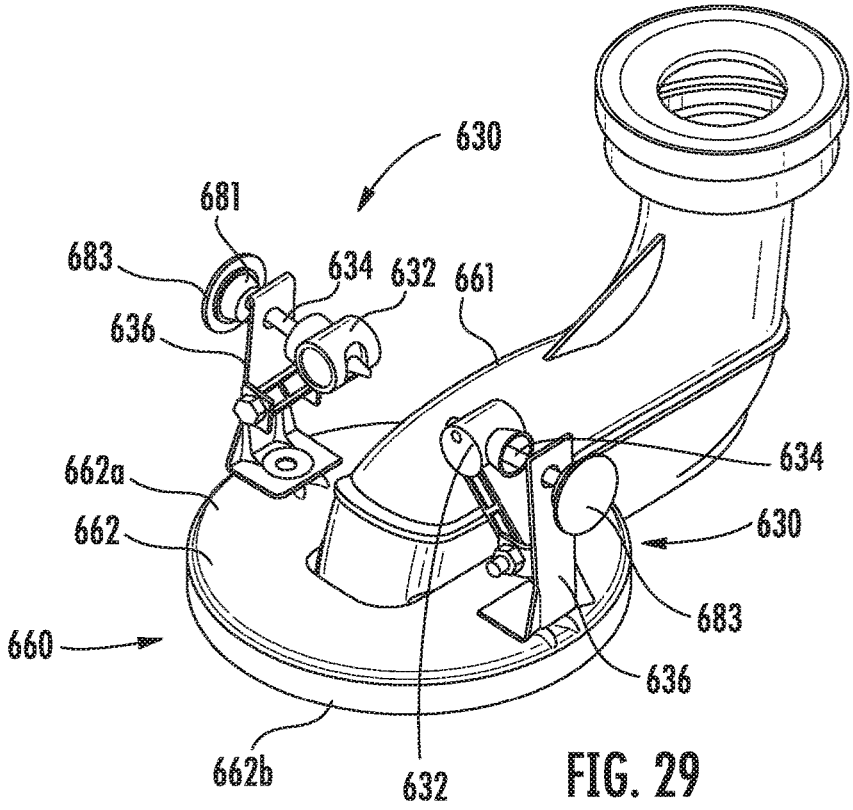
FIG. 29 is a perspective view of another exemplary embodiment of a coupling assembly shown coupled to a trap.
Figure 35:
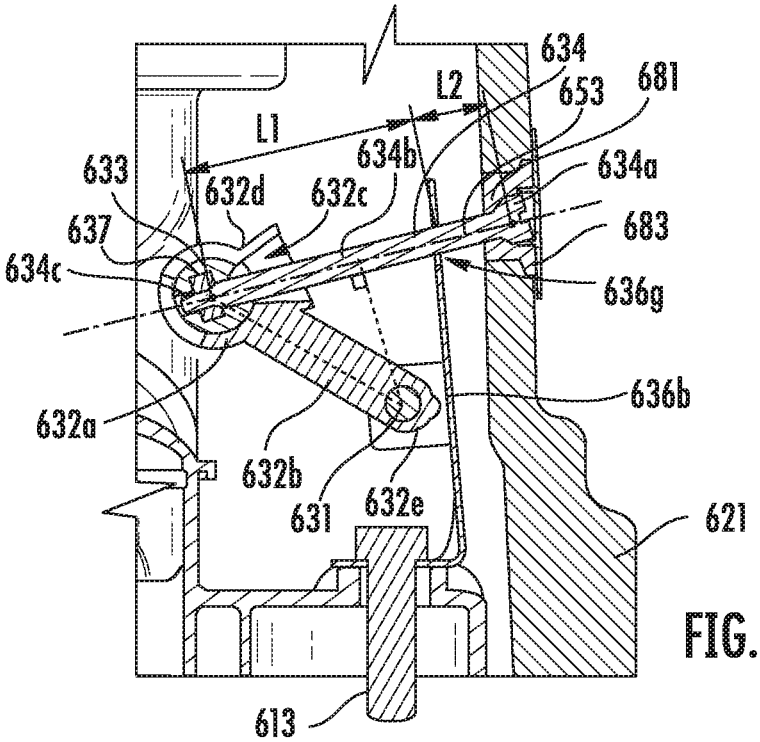
FIG. 35 is a front sectional view of the coupling assembly of FIG. 34 with the clamping member configured in a first (e.g., fully extended) position.

As shown in FIGS. 29 and 30, the mounting assembly 630 may also include a bearing 681 and/or a cap 683, which may be separate elements from the adjusting member 634 or may be integrally formed with the adjusting member 634. The bearing 681 may be configured to engage the wall 622 of the pedestal 621 and allow the head 634*a* to pivot relative to the bearing 681, such as upon adjustment of the adjusting member 634, as shown in FIGS. 34-36. The loads (e.g., the vertical loads) into the pedestal may be configured to pass from the adjusting member 634 to pedestal through the bearing 681. According to an exemplary embodiment, the bearing 681 has a length that is configured to extend beyond the inner surface of the wall 622 of the pedestal (when inserted into the opening 623 in the wall 622), such that an inner surface of the bearing 681 is closer to the support member 636 than the adjacent inner surface of the wall 622. In other words, the length of the bearing 681, such as the shoulder of thereof that passes through the opening 623, may be longer than the thickness of the wall 622. This arrangement may advantageously help the support member 636 act as a load limiting member, as discussed herein, by contacting the bearing 681 prior to or instead of the wall 622 (e.g., its inner surface) under high loading conditions (e.g., yielding load levels). The cap 683 may be configured to cover the head 634*a* and/or the bearing 681 and may have a visible outer surface that may have a color tailored to match the color of the pedestal. The cap 683 may be configured to blend in with the wall 622 of the pedestal 621.

The support member 636 may be configured to connect the mounting assembly 630 to the trap 660. The support member 636 may also be configured to influence the clamping ratio of the coupling assembly, as discussed below. As shown in FIGS. 29-38, the support member 636 includes a foot 636*a* and a leg 636*b* extending away from the foot 636*a* in a generally upward direction (i.e., the leg may extend in a vertical direction or may extend at an angle relative to vertical). The support member 636 may be a metal (e.g., steel sheet metal) part formed by a stamping process or any other suitable material/process, or may be a polymer part formed by injection molding or any other suitable process. However, it may be advantageous to make the support member 636 out of metal. For example, the metal support member 636 may have a tailored strength, which may be configured to deform (e.g., elastically, plastically) prior to other components of the system, such as the one or more than one fastener 613 (e.g., bolt) coupling the trap 660 to the soil pipe 601, to prevent damage to other components. Also, for example, the metal support member 636 is not susceptible to creep, which may be problematic with certain polymer members, since the support member 636 may be subjected to tensile loads when the mounting assembly 630 is coupled to the trap 660 to secure the pedestal 621. Thus, it may be easier to tailor the metal support member 636 to act as a load limiting element in the system, as discussed below in more detail.

Figure 37:
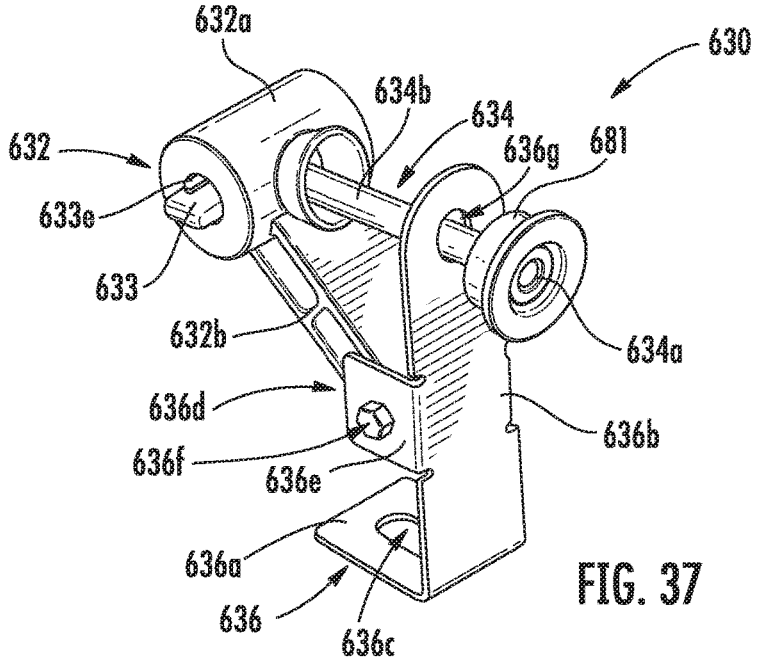
FIG. 37 is a perspective view of an exemplary embodiment of a coupling assembly.

The foot 636*a* is configured to connect the support member 636 to the trap 660. As shown in FIGS. 34 and 37, the foot 636*a* includes an opening 636*c* that is configured to receive a fastener, such as the fastener 613, for coupling the foot 636*a* to the trap 660. Moreover, the fastener 613 may also couple the trap 660 to the soil pipe 601, such that no additional fasteners are required to couple the mounting assembly 630 to the trap 660. The opening 636*c* may be configured as a circular hole, a slotted hole (e.g., an elliptical hole), or may have other suitable shapes. The slotted opening 636*c* may allow the support member 636 to be adjustably coupled to the trap 660. For example, the slotted opening 636*c* may allow the support member 636 to be moved outwardly (i.e., toward the inside of the wall 622 of the pedestal) relative to the trap 660 to further improve the clamping ratio. Alternatively, the support member 636 may be configured to include a plurality of holes 636*c*. For example, the foot 636*a* may include a plurality of offset and aligned holes 636*c*, such as where each center line is aligned along a common line yet each pair of adjacent center lines are offset by a distance that is greater than the diameter of holes (e.g., such that a webbing of material is provided between the offset holes). This configuration may provide the mounting assembly with a specific number of defined positions of the support member 636, yet with each specific position having a fixed connection. The adjustable support member 636 also allows the same mounting assembly 630 to be used with different configurations of toilets, such as toilets having pedestals configured with different widths, and also allows the clamping ratio to be tailored to the specific toilet used within.

The leg 636*b* of the support member 636 may extend generally upward from the foot 636*a*, such that the leg 636*b* is generally vertical. The top portion of the leg 636*b* may include a bent or curved portion relative to the leg 636*b*. As shown in FIG. 30, the bent portion is at the upper most edge of the leg 636*b* and extends away from the leg 636*b*, which may extend away from or toward the wall 622. The bent portion may prevent damage (e.g., scratching) to the vitreous wall 622 of the pedestal 621 when the pedestal 621 is moved (e.g., slid) into position over the mounting assembly 630. For example, a support member 636 having a leg 636*b* with a straight upper edge (i.e., without a bent portion) may scratch the inner wall of the pedestal during coupling, if the wall comes into contact with the upper edge.

The support member 636 includes a pivot to pivotally couple the clamping member 632 to the support member 636. As shown in FIGS. 36 and 37, the leg 636*b* includes a pivot 636*d* configured to pivotally couple the clamping member 632 to the support member 636. The pivot 636*d* may be configured as a tab (e.g., an ear, an arm, etc.) that extends away from the leg 636*b*. As shown, the pivot 636*d* includes a pair of opposing and spaced-apart tabs 636*e* that extend away from the leg 636*b* in a generally perpendicular direction. The pivot 636*d* may also include an opening 636*f* that is configured to receive a pivot member (e.g., a first pivot member 631), which may pivotally couple the support member 636 and clamping member 632 together. As shown, each tab 636*e* includes an opening 636*f*, where the two openings 636*f* are coaxial (e.g., concentric) to define a pivot axis that a pivot member (if included) rotates thereabout when engaging the two openings 636*f*. In other words, the pivot 636*d* may be configured as a clevis, which may advantageously provide a stronger pivot by being in double shear and a more robust pivot by being supported by two tabs, which allow for a more consistent (e.g., repeatable) pivot arc of the clamping member 632. Thus, the pivot member may be a separate element, such as the first pivot member 631 discussed below, that is configured to pivotally couple the clamping member 632 and the support member 636.

Alternatively, the pivot 636*d* of the support member 636 or the clamping member 632 may include an integrally formed pivot member configured to facilitate pivoting of the clamping member 632 relative to the clamping member 636. For example, the integrally formed pivot member may be configured as an extension, a projection, an extruded hole, or another suitable feature extending from either the clamping member 632 or the support member 636 and configured to engage the other member to facilitate pivoting of the clamping member 632 relative to the support member 636.

The support member 636 may be configured to receive the adjusting member 634, such as through an opening in the support member 636. Additionally, the support member 636 may be configured to load the adjusting member 634, such as, for example, by imparting a downward force into the shank 634*b* of the adjusting member 634. As shown in FIGS. 35-37, the leg 636*b* of the support member 636 is configured to receive the shank 634*b* of the adjusting member 634 through a second opening 636*g* in the leg 636*b*. According to an exemplary embodiment, the second opening 636*g* is circular. According to another exemplary embodiment, the second opening 636*g* is slot shaped (e.g., elliptical, oblong, etc.). However, the second opening 636*g* may be configured having other suitable shapes and still be configured to load the adjusting member 634 (e.g., the shank 634*b*).

The support member 636 is configured to load the adjusting member 634 by applying a force (e.g., vertical force) onto the adjusting member 634 when the adjusting member 634 is adjusted to in-turn induce a reaction force onto the pedestal to secure it in place. In other words, when the adjusting member 634 is moved in a tightening direction, it moves relative to the support member 636 to induce an increasing force between the shank 634*b* and the support member 636 and an increasing reaction force between the head 634*a* and the wall 622 of the pedestal 621, such as relative to the pivot axis 643.

The force or load into the support member 636 may be imparted to a surface of the support member that defines the second opening 636*g* in the leg 636*b*. For example, the surface of the support member 636 (that is loaded) may be an upper surface of the second opening 636*g*, such that the load into the support member is a vertical load (e.g., an upward load). This arrangement may allow the upper surface of the second opening 636*g* to act as a fulcrum as a pitch of the adjusting member 634 is changed during adjustment thereof. The pitch refers to the angle of the adjusting member 634 relative to horizontal, which is shown to vary in FIGS. 34-36 according to the level of adjustment of the adjusting member 634. Thus, adjusting (e.g., rotating) the adjustment member 634 is configured to pivot the clamping member 632 relative to the support member 636 to change the pitch of the adjusting member 634, such that the adjusting member 634 imparts a load (e.g., force) into both the support member and the wall of the pedestal. The imparted loads can be increased by continued adjustment (e.g., rotation in a first rotational direction) or can be decreased by a counter-adjustment (e.g., rotation in a second rotational direction that is opposite to the first rotational direction).

Each mounting assembly 630 may also include a first pivot member 631 configured to pivotally couple the clamping member 632 to the support member 636 about a pivot axis 642 (e.g., rotational axis), as shown in FIG. 36. The first pivot member 631 may be configured similar to, the same as, or different than the other pivot members disclosed herein. According to an exemplary embodiment, the first pivot member 631 is configured as a pin that is configured to engage (and be retained in) the clevis of the pivot 636*d* (e.g., the two spaced apart tabs 636*e*) of the support member 636. The pivot member 631 may have a base shoulder that is positioned between the two tabs 636*e* and two smaller sized (e.g., diameter) end shoulders, where each end shoulder is configured to engage the opening in one of the two tabs 636*e*. The pivot member 631 may be a cotter pin. The pivot member 631 may be a single shoulder pin having a center section that receives the opening in the distal end 632*e* of the clamping member 632 and end sections that engage the openings in the tabs 636*e*, which may then be formed-over (e.g., staked) to retain the pivot member 631 to the support member 636. According to another exemplary embodiment, which is shown in FIG. 38, the pivot member 631 is configured as a fastener (e.g., bolt) that engages the pivot 636*d* of the support member 636. This arrangement may utilize a second fastener (e.g., a nut) that engages the first fastener to secure it in place. It is noted that the first pivot member 631 may have other suitable configurations that pivotally couple the support member and the clamping member, and the examples disclosed herein are not limiting.

The distal end 632*e* of the pivot arm 632*b* may include an opening that is configured to receive the first pivot member 631 in order to pivotally couple the clamping member 632 to the support member 636. As shown in FIG. 38, the distal end 632*e* includes a bore that is configured to receive the first pivot member 631 to pivotally couple the clamping member 632 to the support member 636. Alternatively, the distal end 632*e* may include a projection, extension, or other suitable feature that is configured to engage an opening, a bore, or other suitable feature in the support member 636.

Each mounting assembly 630 may also include a second pivot member 633 configured to pivotally couple the clamping member 632 to the adjusting member 634. As shown in FIGS. 33-36, the second pivot member 633 is disposed in a second bore 632*g* of the clamping member 632 and is configured to pivot about a pivot axis 643 (as shown in FIG. 36) relative to the clamping member 632 in the second bore 632*g*.

The second pivot member 633 may include a body 633*a* that is shaped to facilitate rotation relative to the second bore 632*g*. As shown in FIG. 38, the body 633*a* may have a generally cylindrical shape to rotate within the generally cylindrical shape of the second bore 632*g* of the clamping member 632. The second pivot member 633 may include a bore 633*b* in the body 633*a*, where the bore 633*b* is configured to receive the adjusting member 634. The bore 633*b* of the second pivot member 633 may be threaded or may include a threaded portion that is configured to receive the threads of the threaded adjusting member. As shown in FIG. 36, the threaded portion 636*c* extends only a portion of the length of the bore 633*b*. However, the threaded portion 636*c* may extend any length suitable that provides enough engagement between the second pivot member 633 and the adjusting member 634 to maintain the adjustable connection therebetween. Thus, the second pivot member 633 may be formed (e.g., integrally formed) with a threaded bore 633*b* configured to thread to the adjusting member 634.

According to another exemplary embodiment, the second pivot member 633 may include a separately formed threaded member configured to thread to the threads of the adjusting member 634. As shown in FIG. 35, the second pivot member 633 may include a nut 637 that includes a threaded bore configured to thread to the adjusting member 634. The nut 637 may be provided within the pivot member 633 using a press-fit process, an over-molding process (e.g., the pivot member is over-molded around the nut), or any suitable process. This arrangement may advantageously eliminate any creep concern with the threads, such as if the second pivot member 633 is made of a polymer, since the threads of the nut may be made from a metal (e.g., steel). It is noted that the second pivot member 633 may be made out of non-polymer materials, such as metal or other suitable materials.

The bore 633*b* of the second pivot member 633 may also include a lead-in feature to help facilitate inserting the adjusting member 634 into the bore 633*b*. As shown in FIG. 36, the body 633*a* includes a chamfer on the leading edge of the bore 633*b* that defines a frusto-conical portion to improve the ease of assembling the adjusting member 634 and the second pivot member 633 by having a larger opening to insert the adjusting member 634 into. The bore 633*b* of the second pivot member 633 may also include one or more than one clearance shoulders 633*d*, such as shown in FIG. 35.

The second pivot member 633 may also include a feature to limit the rotation of the second pivot member 633 relative to the clamping member 632. As shown in FIGS. 37 and 38, the second pivot member 633 includes a stop element 633*e* that is configured to contact a stop feature of the clamping member 632 to limit the rotational travel of the second pivot member 633 relative to the clamping member 632. For example, the stop element 633*e* may be a shoulder having a shape, such as, for example, a double-D configuration (i.e., a circle truncated by two opposing flat surfaces), where the double-D stop element 633*e* is configured to engage the stop feature of the clamping element 632, which may be one or more surfaces forming the opening to the second bore 632*g* of the clamping member 632, as shown in FIGS. 37-38. This rotational travel limitation may ensure that the bore 633*b* of the second pivot member 633 is always aligned within the opening of the first bore 632*c* of the clamping member 632, such that the adjusting member 634 can engage the bore 633*b* of the second pivot member 633 through the first bore 632*c* of the clamping member 632.

The second bore 632*g* of the clamping member 632, which is configured to pivotally receive the second pivot member 633 may extend transverse to the first bore 632*c* of the clamping member 632. Thus, rotation of the second pivot member 633 relative to the clamping member 632 changes the pitch of the adjusting member 634, as shown in FIGS. 34-36. Moreover, the pivot axis 643 of the second pivot member 633 may be configured to be generally parallel to the pivot axis 642 of the first pivot member 631. The pivot axis 643 of the second pivot member 633 may also be configured to extend in a direction that is transverse to a longitudinal direction 653 (see FIG. 36) of the adjusting member 634 (and hence the direction of the first bore 632*c* of the clamping member).

As shown in FIGS. 34-36, the mounting assembly 630 is configured including a first length L1 that is measured from the pivot axis 643 (e.g., of the second pivot member 633) to the contact location between the support member 636 and the adjusting member 634 (e.g., contact between the upper surface that defines the opening 636*g* and the shank 634*b*) and a second length L2 that is measured from the contact location between the support member 636 and the adjusting member 634 to the contact location between the adjusting member 634 (and/or the bearing 681) and the wall 622 of the pedestal 621 (e.g., contact between the head 634*a* or the bearing 681, if provided, and a lower surface that defines the opening 623 of the wall 622). The first length L1 and/or the second length L2 may be measured transverse to the longitudinal axis 653 of the adjusting member 643, since the adjusting member 634 pivots during adjustment thereof. The first length L1 may be greater than the second length L2, such as to improve the clamping ratio of the mounting assembly and/or to provide relatively higher clamping loads (e.g., vertical forces) into the pedestal 621 compared with the clamping loads imparted into the support member 636 and/or the clamping member 632. It is noted that the first length L1 does not have to be greater than the second length L2, but since the clamping ratio may be influenced by the relationship between the lengths L1 and L2 (e.g., if the second length L2 stays the same, then an increasing first length L1 increases the clamping ratio accordingly), so it may be desirable for certain applications to have such an arrangement.

The mounting assembly 630 configured including the support member 636 may provide several advantages over the coupling assembly not having the support member 636, and only some of the advantages are disclosed herein. First, the support member 636 may be configured as the load limiting feature to prevent damage to other components of the toilet. For example, the support member 636 configured as a load limiting member may prevent overloading the one or more than one fastener 613 that connects the trap 660 to the soil pipe 601 to maintain a proper seal between the trap and drain pipe even if overloaded. Also, for example, by coupling the support member 636 to the system using the fastener 613, which connects the trap 660 to the soil pipe 601, the loads from the mounting assembly 630 are directed into the soil pipe 601 from the support member 636 through the fastener 613 and not through the trap 660. By taking the trap 660 out of the load path of the forces generated by the mounting assembly 630, the likelihood of damage to the trap 660 from such forces is eliminated or greatly reduced, which allows the trap 660 to be configured from a lower strength material (e.g., a polymer). Additionally, the forces (e.g., loads) would have subjected the trap 660 to tensile loading, which would have introduced creep as a concern, such as with respect to the sealing connection. Therefore, taking the trap 660 of the load path has eliminated any such creep concerns, and allows the trap 660 to made from a relatively lightweight and lower strength material, such as a polymer.

Second, the support member (e.g., support member 636) may be configured to provide lateral adjustability, which may advantageously allow the support member 636 to be moved relative to (e.g., farther from, closer to) the wall of the pedestal (e.g., the vitreous wall) and relative to the trap, which is fixed to the drainpipe. By providing lateral adjustability, the coupling assembly having the support member may be used on multiple toilet configurations having different width pedestals. In other words, a single coupling assembly design may be used on various differently configured toilets.

Additionally, moving the support member 636, such as the leg 636*b*, closer to the wall 622 of the pedestal 621 may advantageously improve the clamping ratio. Herein, the term "clamping ratio" is meant to define the ratio of the vertical clamping force(s) to the horizontal clamping force(s) induced by the mounting assembly, such as, for example, the ratio of the vertical clamping forces imparted into the wall of the pedestal to the horizontal clamping forces imparted into the wall of the pedestal. This ratio is important because the vitreous pedestal may be configured to withstand about 150 lbf (about 667.2 N), such as for a single walled vitreous pedestal without any strengthening features (e.g., ribs, braces, supports, etc.), before breaking the vitreous wall, while the typical working range for securing the pedestal to the floor and/or soil pipe is about 100 lbf (about 444.8 N) to 300 lbf (about 1334.5 N). The 100 lbf is the minimum force generally required to secure the pedestal in place, while the 300 lbf is generally where the fasteners securing the toilet to the soil pipe begin to pull through and where creep issues begin to arise. Therefore, the typical design target for clamping the pedestal may be 150 lbf to 200 lbf.

With the above described design targets in mind, a clamping ratio of 0.7:1 is about the minimum design target to be able to secure the toilet in place without damaging the vitreous wall from the horizontal forces. It is preferable to have a clamping ratio of about 1:1 to 4:1, more preferable to have a clamping ratio of about 1.5:1 to 3:1, and even more preferable to have a clamping ratio of about 2:1 to 2.5:1. However, the clamping ratio may change based on at least the parameters discussed herein, so the desired clamping ratio may be changed to accommodate changes in these parameters (e.g., friction).

It is noted that the clamping ratio is influenced by the coefficient of friction, and in particular the friction between the pedestal and the floor. Since the coefficient of friction is a function of the materials used, such as for the pedestal and the floor, the friction will vary with different materials and therefore, different materials which have different coefficients of friction may impact the clamping ratio (e.g., increase, or decrease) accordingly. For this application, the clamping ratios discussed have been based on the pedestal being made from vitreous china and the floor from ceramic tile, but the materials of the pedestal and/or the floor may vary from these examples, and the toilets having mounting assemblies disclosed herein are not limited to use with pedestals and floors with these respective materials, because they are exemplary in nature. Stated differently, since the friction influences the clamping ratio, the above described design targets are representative for the example chosen and may change for different friction values, which may in turn impact the design targets. For example, as the coefficient of friction increases, the design limits may decrease (e.g., maximum vertical load).

It is noted that the clamping ratio of the coupling or mounting assembly including the support member can be tailored to the specific application (e.g., the specific toilet design). In other words, the clamping ratio may be changed, such as by moving the support member 636 closer to or farther from the wall, which may change the second length L2. Also, for example, the clamping ratio may be tailored by changing the first length L1. For example, the first length L1 may be influenced by using a longer fastener (e.g., adjusting member 634), which may increase the clamping ratio to 5:1 or more. However, the longer fastener may also increase the cost of the system.

Figure 39:
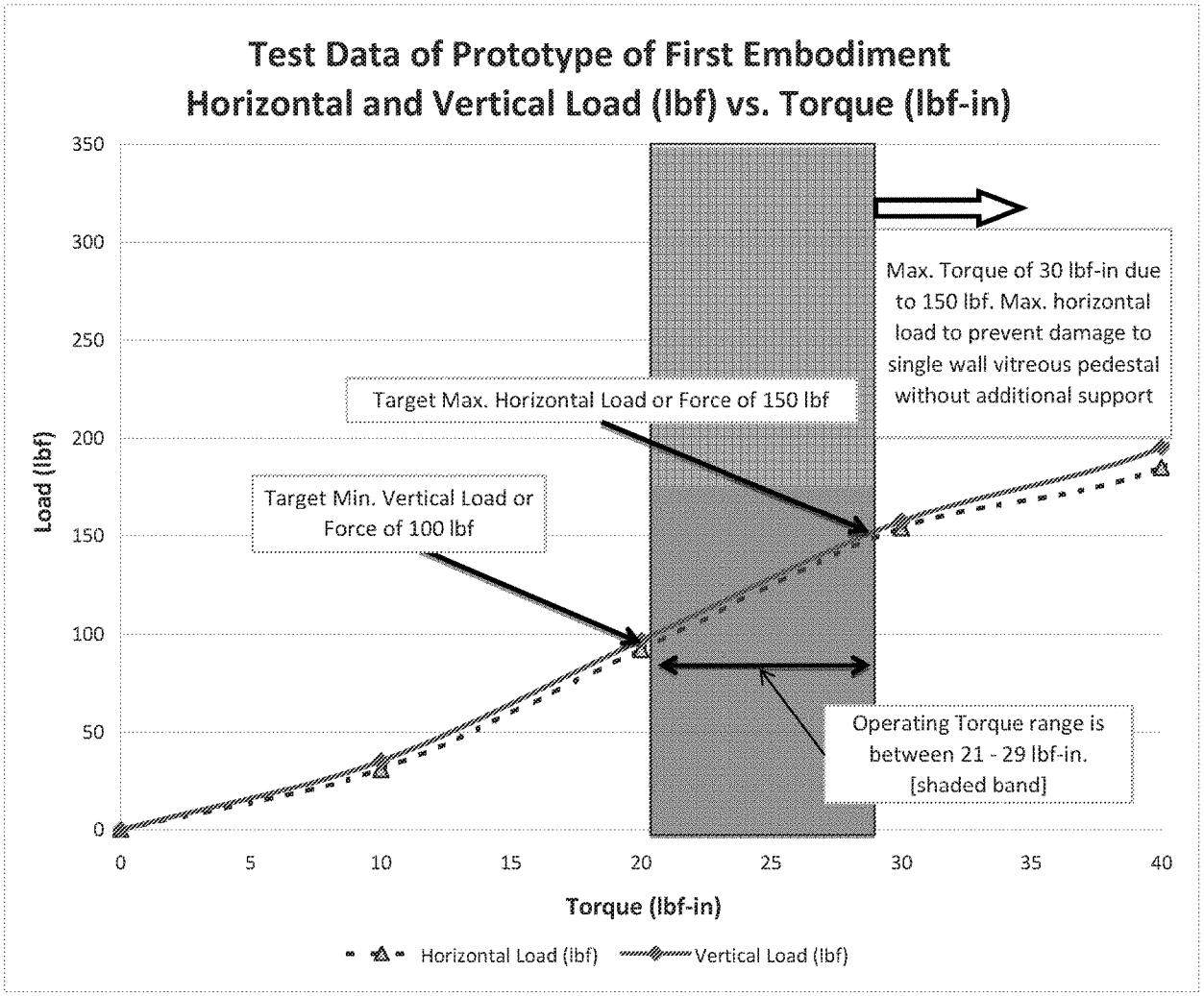
FIG. 39 is a graph illustrating test data of the horizontal and vertical clamping loads over torque for the coupling assembly of FIGS. 21 and 22 configured without a support member.
Figure 40:
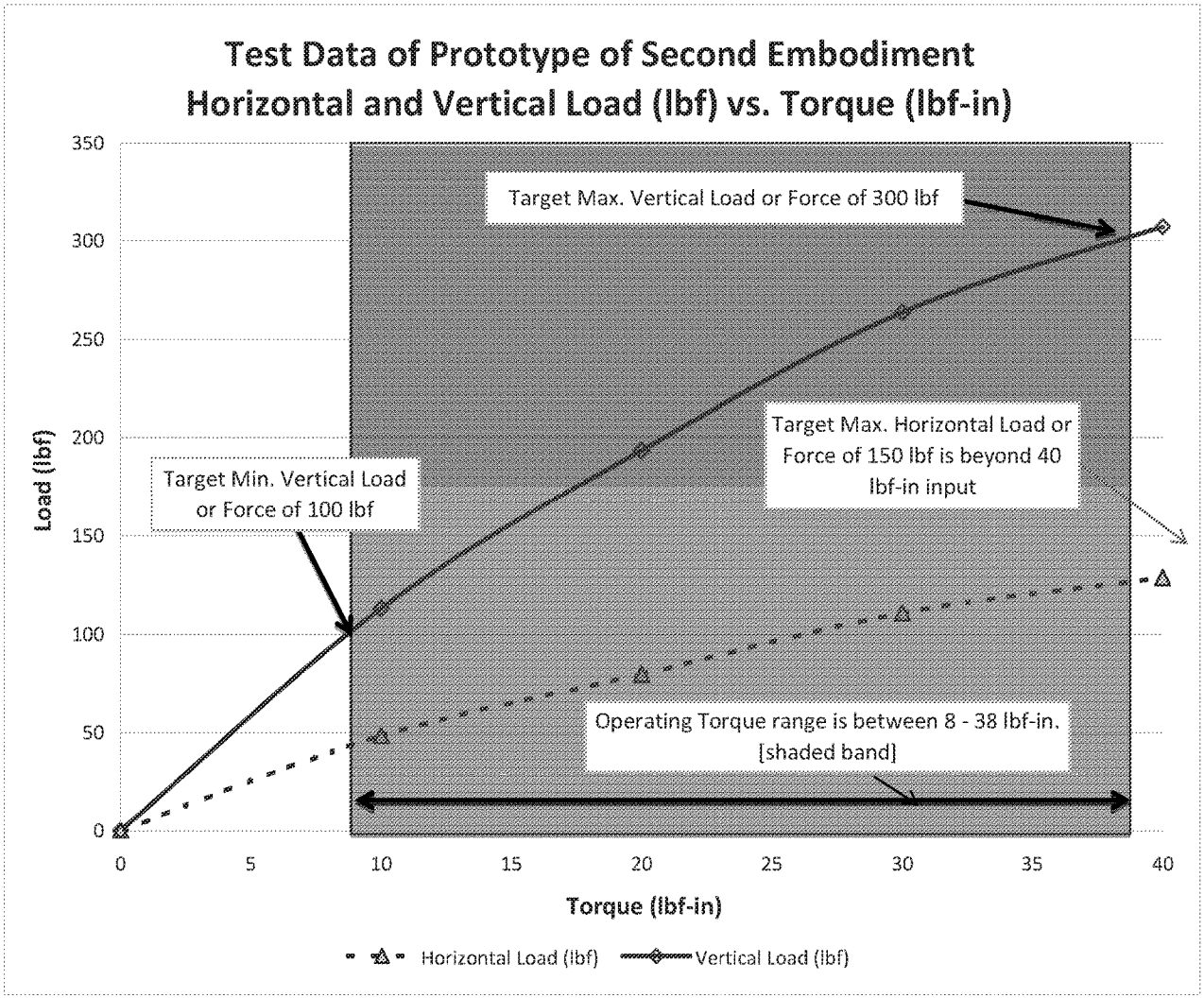
FIG. 40 is a graph illustrating test data of the horizontal and vertical clamp loads over torque for the coupling assembly of FIGS. 37 and 38 configured with a support member.

FIGS. 39-40 are graphs illustrating actual test data of the horizontal and vertical clamping loads over torque for coupling assemblies. FIG. 39 illustrates the test data for the coupling assembly of FIGS. 21 and 22, which is configured without a support member. FIG. 40 illustrates test data of the horizontal and vertical clamp loads over torque for the coupling assembly of FIGS. 37 and 38 configured with a support member.

As discussed above, certain design targets or guidelines were used based on the parameters of the design, which may vary or change for other designs. For example, the upper limit for the horizontal loads or forces was set at 150 lbf to account for the strength of a single wall vitreous china pedestal configured without any additional strengthening features. In other words, a horizontal load of greater than 150 lbf may damage such a pedestal. It is noted that additional strengthening features will increase the maximum strength of the wall, but may also have disadvantages, such as cost, manufacturability, etc. As another example, the working range for vertical loads or forces was set from 100 lbf to 300 lbf, where the lower limit of 100 lbf represents the minimum vertical force to properly secure the pedestal to the floor and the upper limit of 300 lbf represents the maximum vertical force before damage may occur, such as to fasteners securing the toilet to the soil pipe, and where creep issues begin to arise.

Accordingly, the graphs of the test data compare the two designs by evaluating each designs horizontal and vertical forces over the torque to establish a working or operating range of torque, which may be used for each design and fall within the established design guidelines. The relative values of the vertical and horizontal forces for the torque of the respective design illustrates the relative clamping ratio. As shown in FIG. 39, the test data shows that the operating range of torque for the first embodiment is between 21-29 in·lbf, which is bounded by the 100 lbf minimum vertical force and the 150 lbf maximum horizontal force. Moreover, the clamping ratio for the first embodiment is close to 1:1, which is why the operating range of torque is narrower relative to the range of the second embodiment. As shown in FIG. 40, the test data shows that the operating range of torque for the second embodiment is between 8-38 in·lbf, which is bounded by the 100 lbf minimum vertical force and the 300 lbf maximum vertical force. Since the clamping ratio of the second embodiment is about 2.3:1 at a torque of 25 in·lbf, the maximum horizontal load is no longer an issue and the design may eliminate the concern over damaging the wall of the pedestal by imparting too high of horizontal forces. The test data shows that the second embodiment having an increased clamping ratio provides a larger operating torque range, and therefore is a more robust design. This larger operating torque range allows the design to be configured to eliminate or significantly reduce the likelihood of issues in the field. For example, the head of the adjusting member may be configured to strip out at a torque of less than 38 in·lbf (e.g., 30 in·lbf, 35 in·lbf), to ensure that the system does not reach the 300 lbf vertical force threshold. Moreover, the toilet having the mounting assembly according to the second embodiment is easier for the serviceperson or homeowner to install, because it requires a much lower torque to properly secure the pedestal to the floor.

It is noted that the actual test data is not limiting and is exemplary in nature. For example, the coupling assembly without the support member may have a clamping ratio slightly greater than 1:1. In contrast, the coupling assembly (e.g., the mounting assembly 630) including the support member (e.g., the support member 636) may be configured having a clamping ratio that is different than the 2.3:1 shown in the data. For example, the coupling assembly including the support member may, for example, have a clamping ratio of at least 2.5:1. Even with a shorter length fastener (e.g., adjusting member 634), the clamping ratio may reach 3:1. In other words, the magnitude of the vertical clamping forces are at least 2.5 times the magnitude of the horizontal clamping forces for the mounting assembly having the support member, which may reduce the likelihood of damage to the vitreous pedestal resulting from the horizontal clamping forces.

It should be noted that clamping members may have other various configurations, such as, for example, the clamping members may be A-shaped, rectangular shaped, triangular shaped, or may have any suitable shape. The clamping members may be used in coupling or mounting assemblies to more properly secure the toilet in place, such as through the use of an adjusting member.

The toilets disclosed herein having coupling assemblies are able to secure the toilet to the trap and drain pipe (or soil pipe) by applying clamping forces in both the horizontal and vertical directions, as opposed to just the horizontal direction or just the vertical direction. This provides a much more secure coupling between the toilet and the soil pipe and/or trap, which in addition to providing an improved retention of the toilet, provides stability to the toilet, such as during use thereof, and also improves the seal formed between the toilet and the soil pipe to reduce the likelihood of leaking through the seal.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the toilets and installation (or clamping or mounting) systems as shown in the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A method of securing a toilet base, comprising:

coupling a foot of a first support member directly to a first portion of a trap;

pivotally coupling a first clamping member to a leg of the first support member, so that the first clamping member can rotate relative to the first support member;

placing the toilet base over the trap, so that a skirt of the toilet base surrounds the first support member and the first clamping member;

inserting a first adjusting member through a first opening in the skirt so that a shank of the first adjusting member is coupled to a distal end of the first clamping member; and rotating the first adjusting member in a first direction to a secure position in which a head of the first adjusting member loads the skirt and the first support member loads the shank to secure the toilet base to the trap.

2. The method of claim 1, wherein rotating the first adjusting member in the first direction in turn pivots the distal end of the first clamping member about a pivot axis of the first clamping member through a threaded coupling.

3. The method of claim 2, wherein the threaded coupling comprises external threads on the shank of the first adjusting member.

4. The method of claim 1, further comprising rotating the first adjusting member in a second direction, which is opposite the first direction, from the secure position reduces the loads between the head and the first adjusting member and between the shank and the first support member.

5. The method of claim 1, further comprising:

coupling a foot of a second support member to a second portion of the trap;

pivotally coupling a second clamping member to a leg of the second support member, so that the second clamping member can rotate relative to the second support member;

inserting a second adjusting member through a second opening in the skirt so that a shank of the second adjusting member is coupled to a distal end of the second clamping member; and rotating the second adjusting member in a first direction to a secure position in which a head of the second adjusting member loads the skirt and the second support member loads the shank of the second adjusting member to secure the toilet base to the trap.

6. The method of claim 5, wherein the skirt of the toilet base surrounds the first and second support members and the first and second clamping members after the toilet base is placed over the trap.

7. The method of claim 5, wherein the first portion of the trap is on an opposite side of a passageway of the trap from the second portion of the trap.

8. The method of claim 5, wherein each of the first and second adjusting members can be rotated independently of the other adjusting member.

9. A method of securing a toilet base, comprising:

coupling a foot of a support member to a portion of a trap;

pivotally coupling a clamping member to a leg of the support member, so that the clamping member can rotate relative to the support member;

placing the toilet base over the trap, so that a skirt of the toilet base surrounds the support member and the clamping member;

inserting an adjusting member through an opening in the skirt so that a shank of the adjusting member is coupled to a distal end of the clamping member; and rotating the adjusting member in a first direction to a secure position in which a head of the adjusting member loads the skirt and the support member loads the shank to secure the toilet base to the trap, wherein rotating the adjusting member in the first direction in turn pivots the distal end of the clamping member about a pivot axis of the clamping member through a threaded coupling, wherein the threaded coupling comprises external threads on the shank of the adjusting member, wherein a pivot member is rotatably disposed in a first bore of the clamping member, and wherein the threaded coupling further comprises internal threads of the pivot member, so that the external threads on the shank thread to the internal threads of the pivot member.

10. The method of claim 9, wherein the clamping member includes a second bore that extends transverse relative to the first bore, the second bore receives the shank of the adjusting member, and rotating of the adjusting member in the first direction changes a pitch of the shank relative to second bore of the clamping member.

11. A method of securing a toilet base, comprising:

pivotally coupling a first end of a first clamping member to a leg of a first support member, so that first clamping member can rotate about a first pivot axis relative to the first support member;

coupling a foot of the first support member, which extends from the leg, directly to a first portion of a trap;

placing a skirt of the toilet base over the trap, the first support member, and the first clamping member;

inserting a first adjusting member through a first opening in the skirt so that a shank of the first adjusting member is coupled to a second end of the first clamping member; and rotating the first adjusting member in a securing direction to secure the toilet base to the trap through a first load between a head of the first adjusting member and the skirt and a second load between the first support member and the shank.

12. The method of claim 11, wherein a pivot member is rotatably disposed in a first bore of the first clamping member, and the pivot member includes a bore that receives the first adjusting member.

13. The method of claim 12, wherein rotating the first adjusting member in the securing direction drives relative rotation between the pivot member and the first clamping member.

14. The method of claim 13, wherein the shank of the first adjusting member threads to the pivot member, so that rotating the first adjusting member in the securing direction moves the pivot member along the shank through the threads, which in turn pivots the second end of the first clamping member about the first pivot axis.

15. The method of claim 14, wherein further rotating the first adjusting member in the securing direction after contact between the head and the skirt increases the first load and increases the second load.

16. The method of claim 15, wherein rotating the first adjusting member in a loosening direction, which is opposite the securing direction, after contact between the head and the skirt decreases at least the first load.

17. The method of claim 11, further comprising:

pivotally coupling a first end of a second clamping member to a leg of a second support member, so that second clamping member can rotate about a second pivot axis relative to the second support member;

coupling a foot of the second support member, which extends from the leg of the second support member, to a second portion of a trap;

inserting a second adjusting member through a second opening in the skirt so that a shank of the second adjusting member is coupled to a second end of the second clamping member; and rotating the second adjusting member in a securing direction to secure the toilet base to the trap through a third load between a head of the second adjusting member and the skirt and a fourth load between the second support member and the shank of the second adjusting member.

18. The method of claim 17, wherein the first pivot axis and the second pivot axis are parallel to one another and offset on opposite sides of a passageway of the trap from one another.

19. The method of claim 18, wherein the first opening is in a first side of the skirt, the second opening is in a second side of the skirt, and the first and second sides are on opposite sides of the passageway.

20. The method of claim 19, further comprising a first pivot member, which is disposed in a bore of the first clamping member and receives the first adjusting member, and a second pivot member, which is disposed in a bore of the second clamping member and receives the second adjusting member, wherein each pivot member rotates relative to the associated clamping member in response to rotating the associated adjusting member.

* * * * *